US009205644B2

(12) United States Patent
Hosokawa

(10) Patent No.: US 9,205,644 B2
(45) Date of Patent: Dec. 8, 2015

(54) PRINTING APPARATUS AND METHOD OF CONTROLLING PRINTING APPARATUS

(71) Applicant: Seiko Epson Corporation, Tokyo (JP)

(72) Inventor: Yasuhiro Hosokawa, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/479,755

(22) Filed: Sep. 8, 2014

(65) Prior Publication Data

US 2015/0077463 A1 Mar. 19, 2015

(30) Foreign Application Priority Data

Sep. 17, 2013 (JP) ..... 2013-191435

(51) Int. Cl.

| | |
|---|---|
| ***B41J 29/393*** | (2006.01) |
| ***B41J 2/045*** | (2006.01) |
| ***B41J 2/125*** | (2006.01) |
| ***B41J 2/14*** | (2006.01) |
| ***B41J 2/175*** | (2006.01) |

(52) U.S. Cl.

CPC ..... *B41J 2/0451* (2013.01); *B41J 2/04581* (2013.01); *B41J 2/125* (2013.01); *B41J 2/14233* (2013.01); *B41J 2/14274* (2013.01); *B41J 2/175* (2013.01); *B41J 2002/14419* (2013.01)

(58) Field of Classification Search

CPC ..... B41J 2/295; B41J 2/04581; B41J 2002/14258

USPC ..... 347/19, 24, 48

See application file for complete search history.

(56) References Cited

FOREIGN PATENT DOCUMENTS

JP 2013-028183 A 2/2013

*Primary Examiner* — Julian Huffman
*Assistant Examiner* — Sharon A Polk
(74) *Attorney, Agent, or Firm* — Harness, Dickey & Pierce, P.L.C.

(57) ABSTRACT

A printing apparatus includes a piezoelectric element which is displaced according to a driving signal; a first ejection unit and a second ejection unit that include nozzles capable of ejecting; a detection unit that detects a first and second residual vibration signal; and a determination unit that determines an ejection state of the liquid in the first ejection unit to be normal in a case where a cycle of a waveform indicated by the first residual vibration signal belongs to a first range and determines an ejection state of the liquid in the second ejection unit to be normal in a case where a cycle of a waveform indicated by the second residual vibration signal belongs to a second range, in which a part or all of the second range includes a range which is not included in the first range.

5 Claims, 27 Drawing Sheets

TESTED VALUE AND CALCULATED VALUE OF RESIDUAL VIBRATION (NORMAL TIME)

TESTED VALUE AND CALCULATED VALUE OF RESIDUAL VIBRATION (BUBBLE)

TESTED VALUE AND CALCULATED VALUE OF RESIDUAL VIBRATION (DRYING)

TESTED VALUE AND CALCULATED VALUE
OF RESIDUAL VIBRATION (PAPER DUST)

FIG. 16

| SI (b1, b2, b3) | Ts1 | | | Ts2 | | |
|---|---|---|---|---|---|---|
| | Sa | Sb | Sc | Sa | Sb | Sc |
| (1, 1, 0) | H | L | L | H | L | L |
| (1, 0, 0) | H | L | L | L | H | L |
| (0, 1, 0) | L | H | L | H | L | L |
| (0, 0, 0) | L | H | L | L | H | L |
| (0, 0, 1) | L | L | H | L | L | H |

FIG. 22

| Flag | NTc (CONTENTS TO BE COMPARED) | Rs |
|---|---|---|
| 1 | NTc < D1 | 2: EJECTION ABNORMALITY (BUBBLE) |
| | D1 ≤ NTc ≤ D2 | 1: NORMAL |
| | D2 < NTc ≤ D3 | 3: EJECTION ABNORMALITY (PAPER DUST) |
| | D3 < NTc | 4: EJECTION ABNORMALITY (THICKENING) |
| 0 | N/A | 5: EJECTION ABNORMALITY |

PRINTING APPARATUS AND METHOD OF CONTROLLING PRINTING APPARATUS

BACKGROUND

1. Technical Field

The present invention relates to a printing apparatus and a method of controlling a printing apparatus.

2. Related Art

An ink jet printer allows an ink filled in a cavity of an ejection unit to be ejected and forms an image on a recording medium such as recording paper by allowing a piezoelectric element provided in the ejection unit of a head to be driven by a driving signal.

However, when the ink in the cavity is thickened, ejection abnormality occurs and the image quality of the image to be printed is degraded in some cases. Further, in a case where the ink in the cavity includes bubbles or paper dust is adhered to the vicinity of a nozzle of the ejection unit, ejection abnormality occurs and the image quality of the image to be printed is degraded in some cases. Accordingly, it is preferable to inspect an ejection state of the ink in the ejection unit for realizing high grade printing.

JP-A-2013-028183 discloses a technique of detecting residual vibration generated in the ejection unit which includes a piezoelectric element when the piezoelectric element is driven by the driving signal and inspecting whether the ejection state of the ink is normal by determining whether a cycle of the detected residual vibration is in a predetermined range.

On the other hand, the head of the ink jet printer is provided with a plurality ejection units. Among the plurality ejection units, an arrangement position of an ejection unit on the head is different from that of another ejection unit. Accordingly, physical properties of various constituent elements included in the ejection unit such as the piezoelectric element or the cavity, for example, compliance or the like of the cavity is different between one ejection unit and another ejection unit in some cases.

Accordingly, a cycle of the residual vibration generated in respective ejection units in a case where the plurality of ejection units are driven by the same driving signal is different between one ejection unit and another ejection unit in some cases. In other words, there is a case in which the range which can be obtained by the cycle of the residual vibration in a case where the ejection state of the ejection unit is normal is different between one ejection unit and another ejection unit.

Therefore, in a case of using a method in the related art of inspecting the ejection state of the ink in the ejection unit by determining whether the cycle of the residual vibration generated in the ejection unit is in a predetermined range, for example, when the predetermined range is decided such that the predetermined range does not coincide with the range which can be obtained by the cycle of the residual vibration generated in one ejection unit when the ejection state of the one ejection unit is normal, it is difficult to accurately determine the ejection state of the ink in another ejection unit. That is, in a case where the ejection state of the ink in the ejection unit is determined using a method in the related art, even if it is possible to accurately determine the ejection state on one ejection unit, but it is not possible to accurately determine the ejection state on another ejection unit, for example, the state may be erroneously determined as ejection abnormality even though the ejection state of another ejection unit is normal.

SUMMARY

An advantage of some aspects of the invention is to provide a technique of performing determination on an ejection state of an ink in a plurality of ejection units with high precision in a case where an ink jet printer includes the plurality of ejection units.

According to an aspect of the invention, there is provided a printing apparatus including a driving signal generation unit that generates a driving signal; a first ejection unit that includes a first piezoelectric element which is displaced according to the driving signal, a first pressure chamber whose inside is filled with a liquid and in which a pressure in the inside is increased or decreased due to the displacement of the first piezoelectric element based on the driving signal, and a first nozzle which communicates with the first pressure chamber and is capable of ejecting the liquid filled in the inside of the first pressure chamber due to the increase or the decrease of the pressure in the inside of the first pressure chamber; a second ejection unit that includes a second piezoelectric element which is displaced according to the driving signal, a second pressure chamber whose inside is filled with a liquid and in which a pressure in the inside is increased or decreased due to the displacement of the second piezoelectric element based on the driving signal, and a second nozzle which communicates with the second pressure chamber and is capable of ejecting the liquid filled in the inside of the second pressure chamber due to the increase or the decrease of the pressure in the inside of the second pressure chamber; a detection unit that detects change of an electromotive force of the first piezoelectric element as a first residual vibration signal based on change of the pressure in the inside of the first pressure chamber, which is generated after the driving signal is supplied to the first piezoelectric element and detects change of an electromotive force of the second piezoelectric element as the second residual vibration signal based on change of the pressure in the inside of the second pressure chamber, which is generated after the driving signal is supplied to the second piezoelectric element; and a determination unit that determines an ejection state of the liquid in the first ejection unit and the second ejection unit based on the detection result of the detection unit, in which the determination unit determines that the ejection state of the liquid in the first ejection unit is normal in a case where a cycle of a waveform indicated by the first residual vibration signal belongs to a first range and determines that the ejection state of the liquid in the second ejection unit is normal in a case where a cycle of a waveform indicated by the second residual vibration signal belongs to a second range, and a part or all of the second range is a range which is not included in the first range.

The cycle which can be obtained by the cycle of the residual vibration generated in the first ejection unit in a case where the ejection state of the liquid in the first ejection unit is normal does not coincide with the range which can be obtained by the cycle of the residual vibration generated in the second ejection unit in a case where the ejection state in the second ejection unit is normal in some cases. Accordingly, in a case where the ejection state of the liquid in the ejection unit is determined by the fact that the cycle of the residual vibration generated in the ejection unit (the first ejection unit and the second ejection unit) belongs to a predetermined range or not, there is a possibility that the ejection state of at least one ejection unit between the first ejection unit and the second ejection unit cannot be accurately determined.

According to the invention, the ejection state of the liquid in the first ejection unit is determined by the fact that the cycle of the residual vibration generated in the first ejection unit belongs to the first range and the ejection state of the liquid in the second ejection unit is determined by the fact that the cycle of the residual vibration generated in the second ejection unit belongs to the second range at least partially including a range different from the first range. Consequently, even in a case where the range which can be obtained by the residual vibration generated when the ejection state is normal is different between the first ejection unit and the second ejection unit, it is possible to prevent occurrence of the situation in which accurate determination on the ejection state of one of the first ejection unit and the second ejection unit is not possible.

Further, it is preferable that the printing apparatus further include a head unit that is provided with a plurality of the first ejection units and a plurality of the second ejection units, the head unit be divided into a first area, a second area, and a third area located between the first area and the second area, the plurality of first ejection units be provided in the first area and the second area of the head unit, and the plurality of second ejection units be provided in the third area of the head unit.

In a case where the plurality of ejection units are provided, for example, in an array on a head unit, the physical properties such as a pressure chamber and the like included in the ejection unit, for example, compliance and the like are different between the ejection unit positioned in the vicinity of an end portion of the array and the ejection unit positioned in an area (for example, around the center) which is not vicinity of the end portion of the array. Accordingly, the range which can be obtained by the cycle of the residual vibration generated in the ejection unit in a case where the ejection state of the ejection unit is normal is different between a first ejection unit positioned in a first area or a second area which is an area in the vicinity of the end portion of the plurality of ejection units provided in an array and a second ejection unit positioned in a third area excluding the vicinity of the end portion of the array.

According to the aspect, in a case where the ejection state of the liquid in the ejection unit is determined based on the cycle of the residual vibration, it is determined that whether the residual vibration belongs to the first range in the first ejection unit and whether the residual vibration belongs to the second range at least partially including a range different from the first range in the second ejection unit. Accordingly, it is possible to prevent occurrence of the situation in which accurate determination on the ejection state of one of the first ejection unit positioned in the vicinity of the end portion and the second ejection unit positioned in the area excluding the vicinity of the end portion is not possible.

Further, in the above-described printing apparatus, it is preferable that a difference value between an upper limit and a lower limit of the first range be larger than a difference value between an upper limit and a lower limit of the second range.

In a case where the plurality of ejection units are provided, for example, in an array on the head unit, the maximum value (or the minimum value) of a value which can be obtained by the cycle of the residual vibration generated in the ejection unit when the ejection state of the liquid in the ejection unit positioned in the vicinity of the end portion of the array tends to be larger than that of the ejection unit positioned around the center of the array (area excluding the vicinity of the end portion). For this reason, even in a case where the ejection state of the first ejection unit is normal, the state may be erroneously determined as ejection abnormality when it is determined that whether the cycle of the residual vibration belongs to the second range.

According to the aspect of the invention, in a case where the ejection state is erroneously determined as ejection abnormality in the first ejection unit when the ejection state of the first ejection unit is normal and it is determined that whether the cycle of the residual vibration in the first ejection unit belongs to the second range, the ejection state of the first ejection unit is determined that whether the cycle of the residual vibration belongs to the first range which is a range wider than the second range so that accurate determination on the ejection state with reduced probability of the erroneous determination becomes possible.

Further, in the above-described printing apparatus, it is preferable that the upper limit of the first range be different from the upper limit of the second range, and the difference value between the upper limit and the lower limit of the first range be equivalent to the difference value between the upper limit and the lower limit of the second range.

According to the aspect of the invention, in a case where the ejection state is erroneously determined as ejection abnormality in the first ejection unit when the ejection state of the first ejection unit is normal and it is determined that whether the cycle of the residual vibration in the first ejection unit belongs to the second range, the ejection state of the first ejection unit is determined that whether the cycle of the residual vibration belongs to the first range which has an upper limit larger than that of the second range so that accurate determination on the ejection state with reduced probability of the erroneous determination becomes possible.

Further, in the above-described printing apparatus, it is preferable that a Helmholtz resonance frequency of the first ejection unit be lower than a Helmholtz resonance frequency of the second ejection unit.

Further, according to another aspect of the invention, there is provided a method of controlling a printing apparatus which includes a driving signal generation unit that generates a driving signal; a first ejection unit that includes a first piezoelectric element which is displaced according to the driving signal, a first pressure chamber whose inside is filled with a liquid and in which a pressure in the inside is increased or decreased due to the displacement of the first piezoelectric element based on the driving signal, and a first nozzle which communicates with the first pressure chamber and is capable of ejecting the liquid filled in the inside of the first pressure chamber due to the increase or the decrease of the pressure in the inside of the first pressure chamber; a second ejection unit that includes a second piezoelectric element which is displaced according to the driving signal, a second pressure chamber whose inside is filled with a liquid and in which a pressure in the inside is increased or decreased due to the displacement of the second piezoelectric element based on the driving signal, and a second nozzle which communicates with the second pressure chamber and is capable of ejecting the liquid filled in the inside of the second pressure chamber due to the increase or the decrease of the pressure in the inside of the second pressure chamber; and a detection unit that detects change of an electromotive force of the first piezoelectric element as a first residual vibration signal based on change of the pressure in the inside of the first pressure chamber, which is generated after the driving signal is supplied to the first piezoelectric element and detects change of an electromotive force of the second piezoelectric element as the second residual vibration signal based on change of the pressure in the inside of the second pressure chamber, which is generated after the driving signal is supplied to the second piezoelectric element, the method including determining an ejection state of the liquid in the first ejection unit to be normal in a case where a cycle of a waveform indicated by the first residual vibration signal belongs to a first range; and determining the ejection state of the liquid in the second ejection unit to be normal in a case where a cycle of a waveform indicated by the second residual vibration signal belongs to a second range, in which a part or all of the second range is a range which is not included in the first range.

BRIEF DESCRIPTION OF THE DRAWINGS

The invention will be described with reference to the accompanying drawings, wherein like numbers reference like elements.

FIG. 16 is an explanatory diagram illustrating the contents of decoding of a decoder.

FIG. 22 is an explanatory diagram describing a determination result signal in a determination unit.

DESCRIPTION OF EXEMPLARY EMBODIMENTS

Hereinafter, embodiments for implementing the present invention will be described with reference to the drawings. However, throughout the drawings, dimensions and scaling of the respective parts are appropriately different from those of actual parts. Moreover, since embodiments described herein are preferred concrete examples of the present invention, the embodiments are provided with various limitations that are technologically preferred, but the scope of the present invention is not limited to the embodiments unless there is particularly a disclosure which limits the present invention in the following description.

A. First Embodiment

In the present embodiment, it will be described that an ink jet printer that ejects ink (one example of a "liquid") to form an image on recording paper P is exemplified as a printer.

1. Configuration of Ink Jet Printer

Figure 1:
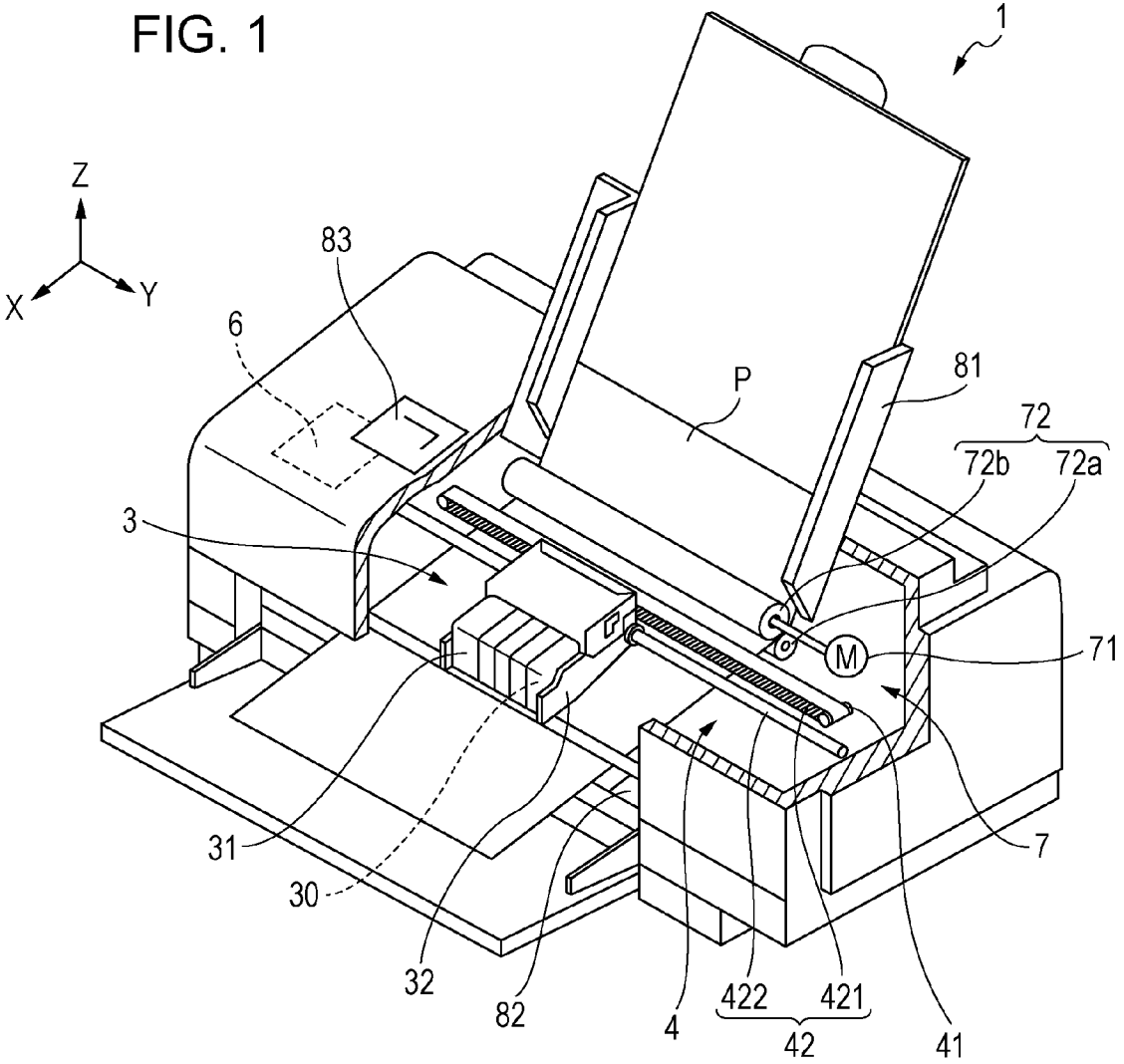
FIG. 1 is a schematic view illustrating an outline of a configuration of an ink jet printer according to a first embodiment of the invention.

FIG. 1 is a schematic perspective view illustrating a configuration of an ink jet printer 1 according to the present embodiment. The configuration of the ink jet printer 1 will be described with reference to FIG. 1. Further, in the following description, in FIG. 1, an upper side (+Z direction) is also referred to an "upper part", a lower side (−Z direction) is also referred to as a "lower part."

As illustrated in FIG. 1, the ink jet printer 1 includes a tray 81 that positions the recording paper P on an upper rear side, a paper delivery port 82 that delivers the recording paper P on a front lower side, and an operation panel 83 on an upper surface. The operation panel 83 includes a liquid-crystal display, an organic EL display, or an LED lamp, and includes a display unit (not illustrated) that displays an error message, and an operation unit (not illustrated) that includes various switches. The display unit of the operation panel 83 functions as a notification unit.

Moreover, as illustrated in FIG. 1, the ink jet printer 1 includes a printing unit 4 having a moving body 3 that reciprocates.

The moving body 3 includes a head unit 30 that includes 4M number of ejection units 35, four ink cartridges 31, and a carriage 32 on which the head unit 30 and the four ink cartridges 31 are mounted (M is a natural number of three or more). The respective ejection units 35 may have the insides thereof filled with inks supplied from the ink cartridges 31, and eject the filled inks. Moreover, the four ink cartridges 31 are provided in a one-to-one correspondence with four colors of yellow, cyan, magenta and black, and the respective ink cartridges 31 are filled with inks of colors corresponding to the ink cartridges 31.

Each of the 4M number of ejection units 35 receives the ink from any one of the four ink cartridges 31. Accordingly, the four colors of inks can be ejected from the 4M number of ejection units 35 as a whole, so that full color printing is realized.

Moreover, the ink cartridges 31 may be provided at another location on the ink jet printer 1 other than the carriage 32.

As illustrated in FIG. 1, the printing unit 4 includes a carriage motor 41 serving as a driving source that allows the moving body 3 to move (reciprocate) in a main scanning direction, a carriage motor driver 43 (see FIG. 2) for driving the carriage motor 41, and a reciprocating mechanism 42 that receives a rotation of the carriage motor 41 to allow the moving body 3 to reciprocate. Further, the main scanning direction is a direction in which a Y-axis extends in FIG. 1.

The reciprocating mechanism 42 has a carriage guide shaft 422 whose both ends are supported by a frame (not illustrated), and a timing belt 421 that extends in parallel with the carriage guide shaft 422. The carriage 32 of the moving body 3 is supported by the carriage guide shaft 422 of the reciprocating mechanism 42 to be able to reciprocate, and is fixed to a part of the timing belt 421. For this reason, when the timing belt 421 is moved in a forward or reverse direction through a pulley by an operation of the carriage motor 41, the moving body 3 is guided by the carriage guide shaft 422 to reciprocate.

Moreover, as illustrated in FIG. 1, the ink jet printer 1 includes a paper feed device 7 that supplies or discharges the recording paper P to or from the printing unit 4.

The paper feed device 7 includes a paper feed motor for transporting the recording paper P, a paper feed motor driver 73 for driving the paper motor 71 (see FIG. 2), and paper feed rollers 72 rotated by an operation of the paper feed motor 71.

The paper feed rollers 72 include a driven roller 72*a* and a driving roller 72*b* that face toward upper and lower sides with a transportation route (the recording paper P) of the recording paper P interposed therebetween, and the driving roller 72*b* is connected to the paper feed motor 71. Thus, the paper feed rollers 72 send a plurality of sheets of recording paper P positioned in the tray 81 toward the printing unit 4 one by one, or discharge the plurality of sheets of recording paper from the printing unit 4 one by one. Further, a paper feed cassette that accommodates the recording paper P may be detachably attached instead of the tray 81.

Moreover, as illustrated in FIG. 1, the ink jet printer 1 includes a control unit 6 that controls the printing unit 4 and the paper feed device 7.

The control unit 6 performs a printing process on the recording paper P by controlling the printing unit 4 and the paper feed device 7 based on image data Img input from a host computer 9 such as a personal computer or a digital camera.

Specifically, the control unit 6 controls the carriage motor 41 via the carriage motor driver 43 so as to intermittently send the recording paper P in a sub scanning direction (an X-axis direction) one by one, and controls the paper feed motor 71 via the paper motor driver 73 so that the moving body 3 to reciprocate in the main scanning direction (a Y-axis direction) crossing with the sending direction (the X-axis direction) of the recording paper P. Simultaneously, the control unit 6 controls the amount of ink ejected from each ejection units 35 and the ejection timing via the head driver 50 described later. Accordingly, the control unit 6 adjusts the dot sizes and the dot dispositions formed by the ink ejected on the recording paper P, and performs the printing process which forms an image corresponding to the image data Img on the recording paper P.

Further, the control unit 6 displays an error message on the display unit of the operation panel 83, and allows the respective parts to perform the corresponding processes based on depression signals of various switches input from the operation unit of the operation panel 83. Furthermore, the control unit 6 may perform a process of transferring information of ejection abnormality or an error message to the host computer 9 if necessary.

Figure 2:
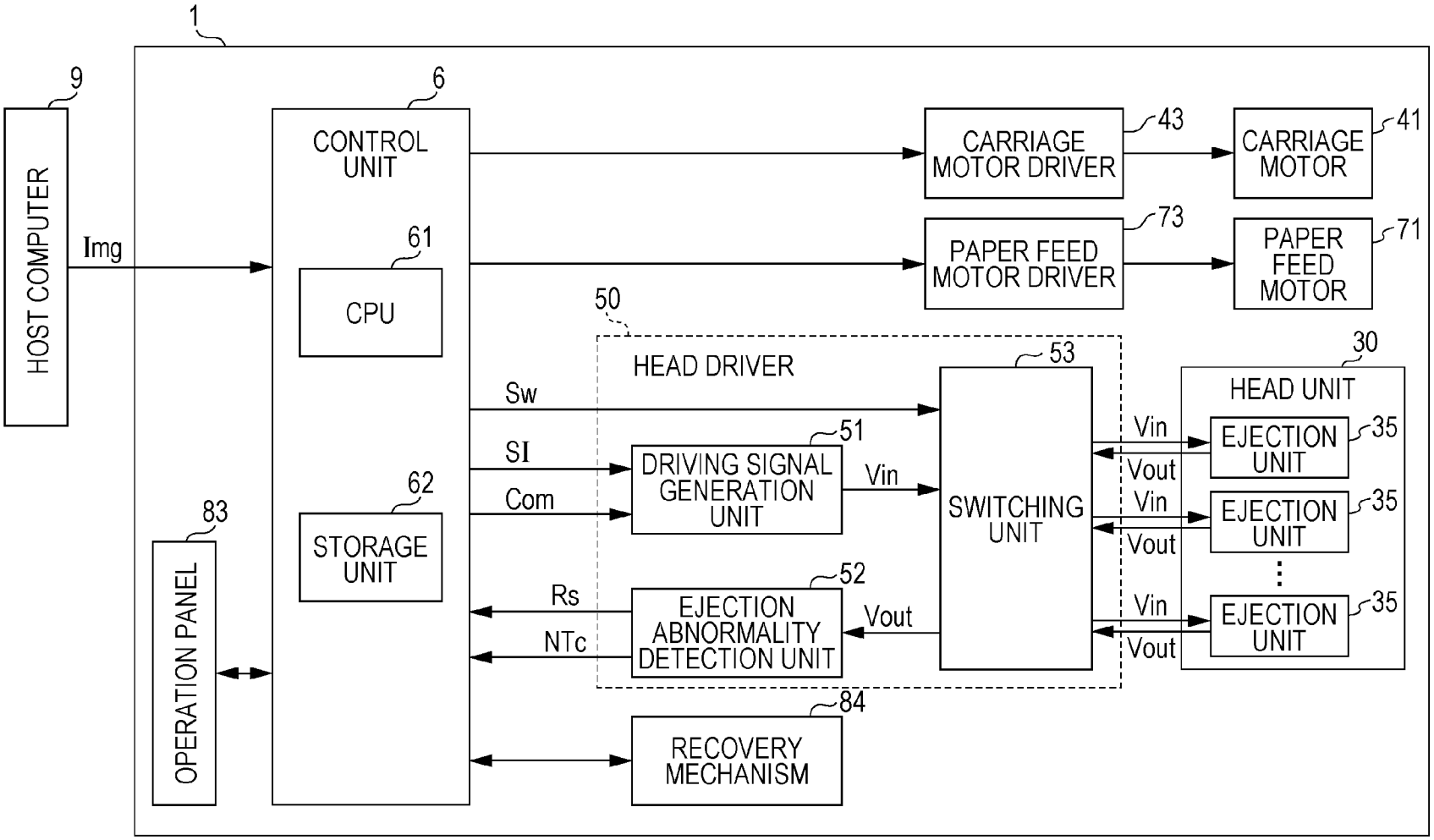
FIG. 2 is a block diagram illustrating the configuration of the ink jet printer.

FIG. 2 is a functional block diagram illustrating the configuration of the ink jet printer 1 according to the present embodiment.

The ink jet printer 1 includes the head unit 30 including the 4M number of ejection units 35, a head driver that drives the head unit 30 and detects ejection abnormality of the ejection unit 35, and a recovery mechanism 84 that recovers the ejection unit 35 from the ejection abnormality to normality when the ejection abnormality of the ejection unit 35 is detected. Moreover, as described above, the ink jet printer 1 includes the carriage motor 41, a carriage motor driver 43, the paper feed motor 71, a paper feed motor driver 73, and the control unit 6 for controlling the operations of the respective parts of the ink jet printer 1.

As illustrated in FIG. 2, the control unit 6 includes a CPU 61, and a storage unit 62.

The storage unit 62 includes an EEPROM (Electrically Erasable Programmable Read-Only Memory) which is a kind of a non-volatile semiconductor memory that stores the image data Img supplied through a non-illustrated interface unit from the host computer 9 in a data storage area, a RAM (Random Access Memory) that temporarily stores data required to perform various processes such as a printing process and the like and temporarily develops a control program for executing various processes such as a printing process and the like, and a PROM which is a kind of a non-volatile semiconductor memory that stores the control program for controlling the respective parts of the ink jet printer 1.

The CPU 61 stores the image date Img supplied from the host computer 9 in the storage unit 62.

Moreover, based on various data such as the image data Img stored in the storage unit 62, the CPU 61 generates a printing signal SI for driving the ejection units 35 by controlling the operation of the head driver 50, various signals such as a switching control signal Sw and a driving waveform signal Com, and outputs the generated signals.

In addition, the CPU 61 generates a control signal for controlling the operation of the carriage motor driver 43, a control signal for driving the operation of the paper feed motor driver 73, a control signal for controlling the operation of the recovery mechanism 84, and a control signal for controlling the operation of the operation panel 83, and outputs the generated signals, based on various data stored in the storage unit 62.

The head driver 50 includes a driving signal generation unit 51, an ejection abnormality detection unit 52, and a switching unit 53.

The driving signal generation unit 51 generates a driving signal Vin for driving the ejection units 35 included in the head unit 30 based on the signal such as the printing signal SI and the driving waveform signal Com supplied from the control unit 6. Further, although details will be described below, the driving waveform signal Com in the present embodiment includes driving waveform signals Com-A, Com-B and Com-C.

The ejection abnormality detection unit 52 detects, as a residual vibration signal Vout, a change of an internal pressure of the ejection unit 35 caused by vibration of the ink within the ejection unit 35 which is generated after the ejection unit 35 is driven by the driving signal Vin. Moreover, the ejection abnormality detection unit 52 determines an ejection state of the ink in the ejection unit 35 such as whether or not the ejection abnormality occurs in the ejection unit 35 based on the residual vibration signal Vout, and outputs a determination result signal Rs representing the determination result. Moreover, the ejection abnormality detection unit 52 outputs a detection signal NTc representing a cycle Tc which is a time length of one wavelength of a waveform represented by the residual vibration signal Vout.

The switching unit 53 electrically connects the respective ejection units 35 to any one of the driving signal generation unit 51 and the ejection abnormality detection unit 52, based on the switching control signal Sw supplied from the control unit 6.

As stated above, the control unit 6 (the CPU 61) controls the operations of the respective parts of the ink jet printer 1 by generating various control signals such as the driving waveform signal Com, the switching control signal Sw to supply the generated signals to the respective parts of the ink jet printer 1.

Thus, the control unit 6 (the CPU 61) executes various processes such as the printing process, the ejection state determining process, the recovery process, and the determination standard deciding process.

Here, the printing process is a process of ejecting the ink from each ejection units 35 to form an image on the recording paper P by controlling the operation of the head driver 50 by the control unit 6 based on the image data Img.

Moreover, the ejection state determining process is a process of generating residual vibration in the ejection unit 35 to determine the ejection state of the ink in the ejection unit 35 based on the generated residual vibration by controlling the operation of the head driver 50 to supply the driving signal Vin for inspection to the ejection unit 35 by the control unit 6.

Moreover, the recovery process is referred to as a process for recovering the ejection state of the ink of the ejection unit 35 to the normality such as a wiping process of wiping a foreign substance such as paper powder attached to a nozzle plate 240 of the ejection unit 35 by a wiper (not illustrated) when the ejection abnormality of the ink is detected in the ejection unit 35 in the ejection state determining process using the recovery mechanism 84, a pumping process of sucking ink or bubbles thickened within the ejection unit 35 by a tube pump (not illustrated), or a flushing process of preliminarily ejecting the ink from the ejection unit 35. The control unit 6 selects one or two or more recovery processes appropriate to recover the ejection state of the ejection unit 35 from among the flushing process, the wiping process and the pumping process, based on the result of ejection state determining process, and executes the selected recovery process.

In addition, the determination criteria decision process is a process of deciding determination criteria used for determination of the control unit 6 on the ejection state determining process.

In the ejection state determining process, the ejection state of the ink in the ejection unit 35 is determined based on the cycle Tc of the residual vibration signal Vout, but it is necessary to decide determination criteria such as the range or the like of the cycle Tc in advance, in which the ejection state of the ink in the ejection unit 35 can be considered as normal for performing the ejection state determining process.

The determination criteria decision process is a process of deciding a value (for example, the range of the cycle Tc in which the ejection state of the ink in the ejection unit 35 can be considered as normal) used as determination criteria when the determination on the ejection state is made based on the cycle Tc of the residual vibration signal Vout in the ejection state determining process.

2. Configuration of Head Unit

Next, the head unit 30 and the ejection unit 35 provided in the head unit 30 will be described with reference to FIG. 3.

Figure 3:
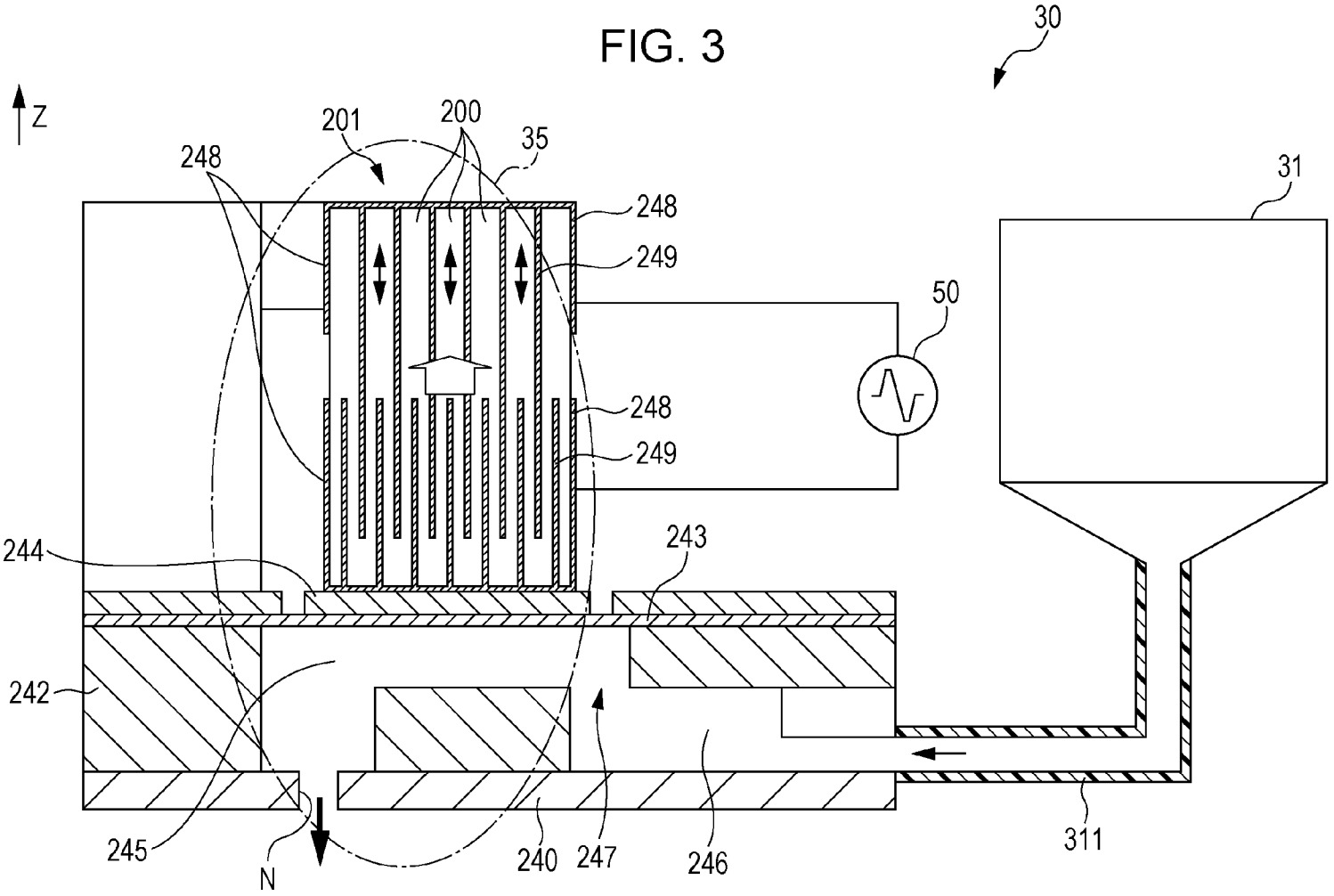
FIG. 3 is a cross-sectional view schematically illustrating a head unit.

FIG. 3 schematically illustrates an example of a cross-sectional view of the head unit 30 and the ink cartridge 31. Further, for convenience of illustration, in the head unit 30, one ejection unit 35 among 4M number of ejection units 35 and the reservoir 246 communicating with the ejection unit 35 through the ink supply port 247 are illustrated in the figure.

AS illustrated in FIG. 3, the ejection nit 35 includes a laminated piezoelectric element 201 formed by a plurality of piezoelectric elements 200 being laminated, a cavity 245 whose inside is filled with the ink (an example of a "pressure chamber"), nozzles N communicating with the cavity 245, and a vibration plate 243. In the ejection unit 35, the ink in the cavity 245 is ejected from the nozzles N due to the driving of the piezoelectric element 200.

As illustrated in FIG. 3, the cavity 245 of the ejection unit 35 is a space divided by a cavity plate 242 formed to have a predetermined shape in which a concave portion is formed, a nozzle plate 240 on which the nozzles N are formed, and a vibration plate 243. The cavity 245 communicates with the reservoir 246 which is a space divided by the cavity plate 242 and the nozzle plate 240 through the ink supplying opening 247. The reservoir 246 communicates with the ink cartridge 31 through the ink supply tube 311.

In FIG. 3, a lower end of the laminated piezoelectric element 201 is bonded to the vibration plate 243 through an intermediate layer 244. A plurality of outer electrodes 248 and a plurality of inner electrodes 249 are bonded to the laminated piezoelectric element 201. That is, the outer electrodes 248 are bonded to an outer surface of the laminated piezoelectric element 201, and the inner electrodes 249 are provided between the piezoelectric elements 200 constituting the laminated piezoelectric element 201. In this case, some of the outer electrodes 248 and the inner electrodes 249 are alternately arranged so as to be overlapped in a thickness direction of the piezoelectric element 200.

In addition, the laminated piezoelectric element 201 is deformed as indicated by arrow of FIG. 3 (expands and contracts in an up and down direction in FIG. 3) to vibrate by supplying the driving signal Vin between the outer electrodes 248 and the inner electrodes 249 from the driving signal generation unit 51, and the vibration plate 243 vibrates by the vibration. A volume of the cavity 245 (a pressure within the cavity 245) is changed by the vibration of the vibration plate 243, and the ink filled into the cavity 245 is ejected from the nozzles N.

When the ink within the cavity 245 is reduced by the ejection of the ink, the ink is supplied from the reservoir 246. Moreover, the ink is supplied from the ink cartridge 31 through an ink supply tube 311 to the reservoir 246.

Figure 4:
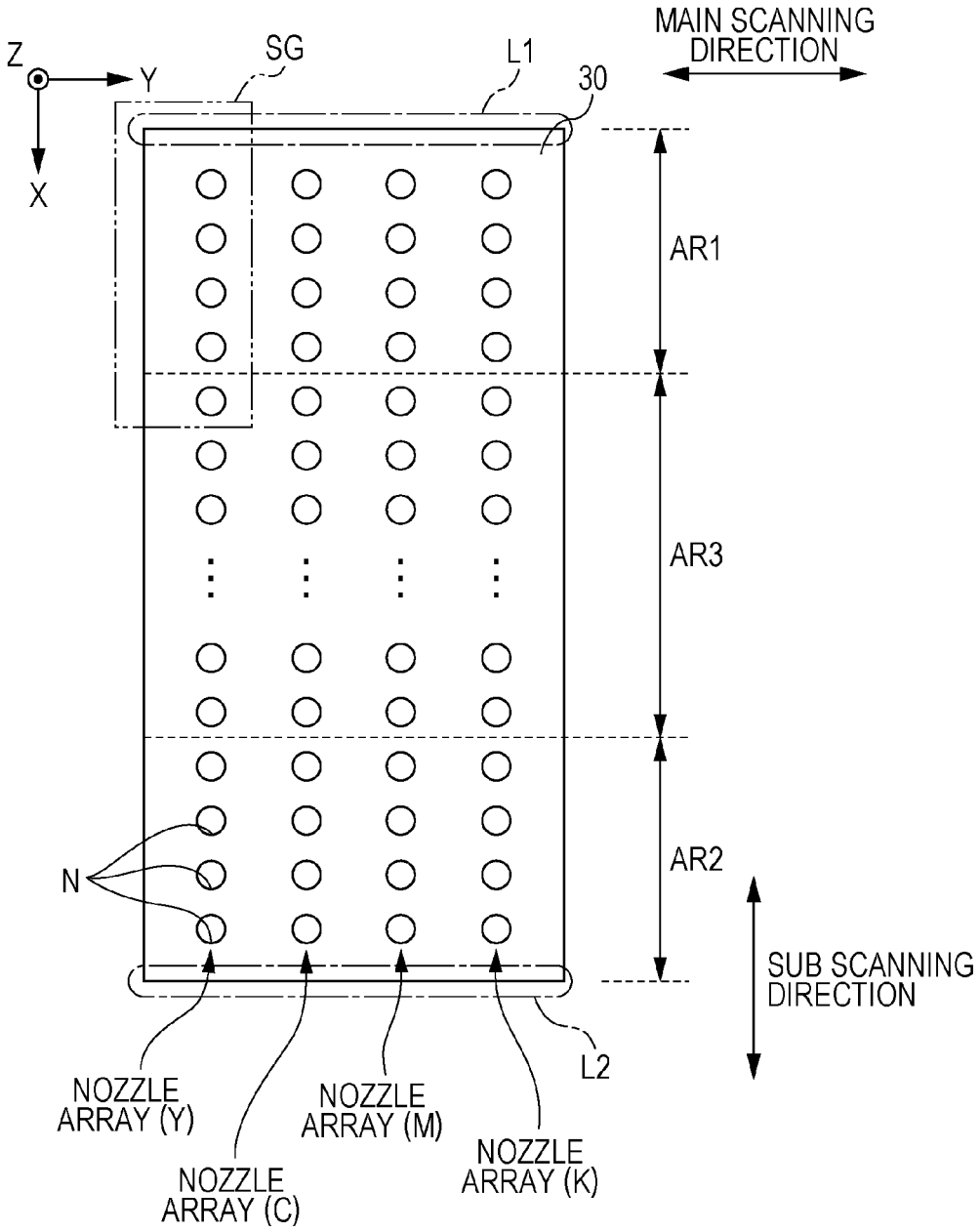
FIG. 4 is a plan view illustrating an arrangement example of nozzles in the head unit.
Figure 5:
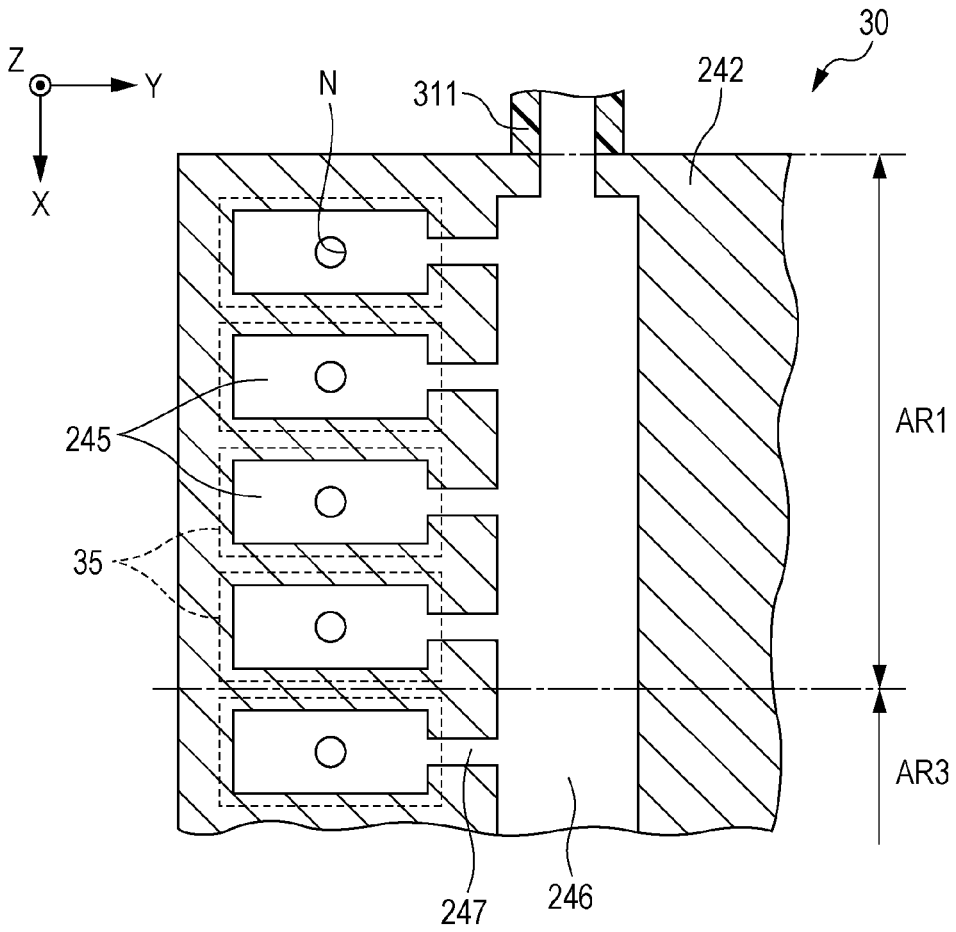
FIG. 5 is an explanatory diagram describing a position relationship between an ejection unit and a reservoir in the head unit.

In addition, FIGS. 4 and 5 illustrate arrangement of 4M number of nozzles N and 4M number of ejection units 35 in the head unit 30.

Here, FIG. 4 is a view illustrating a positional relationship between the head unit 30 and the 4M number of nozzles N included in the head unit 30 when the head unit 30 is seen in a plan view (that is, when seen in a +Z direction or −Z direction).

As illustrated in FIG. 4, the 4M number of nozzles N are arranged M rows×4 columns such that the 4M number of nozzles N become M rows in the X-axis direction and 4 columns in the Y-axis direction. Here, the M-number of nozzles N extending in the X-axis direction are referred to as nozzle arrays. That is, the 4M number of nozzles N are arranged by being divided into 4 nozzle arrays. These 4 nozzle arrays are in one-to-one correspondence with four colors of yellow (Y), cyan (C), magenta (M), and black (K). That is, 4 columns of nozzle arrays are formed of a nozzle array corresponding to yellow (Y), a nozzle array corresponding to cyan (C), a nozzle array corresponding to magenta (M), and a nozzle array corresponding to black (K). Further, pitches between the nozzles N can be appropriately set according to printing resolution (dpi: dot per inch).

Here, $\alpha$, $\beta 1$, and $\beta 2$ are natural numbers satisfying a relationship of $\alpha+\beta 1+\beta 2=M$, and as illustrated in FIG. 4, the head unit 30 is divided into three areas which are an area AR1 provided with $\beta 1$ number of nozzles N among the M number of nozzles N belonging to the respective nozzle arrays, an area AR2 provided with $\beta 2$ number of nozzle N among the M number of nozzles N belonging to the respective nozzle arrays, and an area AR3 provided with $\alpha$ number of nozzles N among the M number of nozzles N belonging to the respective nozzle arrays.

More specifically, the area AR1 is an area including an upper end L1 of the head unit 30 (edge of the head unit 30 in a −X direction) when the head unit 30 is seen in a plan view and is decided as an area provided with $\beta 1$ number of nozzles N among M number of nozzles N belonging to the respective nozzle arrays.

Further, the area AR2 is an area including a lower end L2 of the head unit 30 (edge of the head unit 30 in a +X direction) when the head unit 30 is seen in a plan view and is decided as an area provided with $\beta 2$ number of nozzles N among M number of nozzles N belonging to the respective nozzle arrays.

Further, the area AR3 is an area between the area AR1 and AR2 when the head unit 30 is seen in a plan view and is decided as an area provided with $\alpha$ number of nozzles N among M number of nozzles N belonging to the respective nozzle arrays.

Here, the area AR1 is an example of the "first area," the area AR2 is an example of the "second area," and the area AR3 is an example of the "third area."

In the present embodiment, the area AR1 and the area AR2 are provided such that a relationship of "$\beta 1=\beta 2$." That is, in the present embodiment, the area AR1 and the area AR2 are provided such that the number of nozzles N provided in the area AR1 becomes equivalent to the number of nozzles N provided in the area AR2. However, the present invention is not limited thereto and $\beta 1$ may have a value different from that of $\beta 2$.

Moreover, in the present embodiment, the areas AR1 to AR3 are provided such that a relationship of "$\alpha>\beta 1+\beta 2$." However, the invention is not limited thereto and a relationship of "$\alpha\leq\beta 1+\beta 2$" may be satisfied.

Further, Hereinafter, a natural value $\beta$ is defined as "$\beta=\beta 1+\beta 2$."

In addition, hereinafter, the nozzles N provided in the area AR1 or the area AR2 among nozzles N are referred to as peripheral edge nozzles (an example of "the first nozzle" and the nozzles N provided on the area AR3 are referred to as central nozzles (an example of the "second nozzle"). That is, M number of nozzles N belonging to respective nozzle arrays are classified into $\alpha$ number of central nozzles and $\beta$ number of peripheral edge nozzles.

FIG. 5 is a view illustrating an example of a positional relationship between the ejection unit 35 including nozzles N and the cavity 245, and the reservoir 246 when the head unit 30 is seen in a plan view.

AS illustrated in the figure, when seen in a plan view, the area provided with the nozzles N is included in an area provided with ejection units 35 (cavity 245) including the nozzles N. Further, the M number of ejection units 35 (M number of cavities 245) belonging to respective nozzle arrays are connected to the reservoir 246 which is filled with the ink having a color corresponding to the nozzle array through the ink supplying opening 247 communicating with the respective cavities 245.

Further, when seen in a plan view, the ejection units 35 (cavities 245) corresponding to the central nozzles are provided in the area AR3 and the ejection units 35 (cavities 245) corresponding to the peripheral edge nozzles are provided in the area AR1 or AR2.

Hereinafter, among the ejection units 35, the ejection units 35 provided in the area AR1 or AR2 are referred to as peripheral edge ejection units (an example of the "first ejection unit") and the ejection units 35 provided in the area AR3 are referred to as central ejection units (an example of the "second ejection unit"). That is, the M number of ejection units 35 corresponding to the M number of nozzles N belonging to the respective nozzle arrays are classified into $\alpha$ number of central ejection units and $\beta$ number of peripheral edge ejection units.

Further, the piezoelectric element 200, the cavity 245, the nozzles N included in the peripheral edge ejection units are respectively an example of the "first piezoelectric element," the "first pressure chamber," and the "first nozzles," and the piezoelectric element 200, the cavity 245, and the nozzles N included in the central ejection units are respectively an example of the "second piezoelectric element," the "second pressure chamber," and the "second nozzles."

3. Regarding Residual Vibration

Next, the ejection of the ink in the ejection unit 35 will be described with reference to FIGS. 6A to 6C.

Figure 6A:
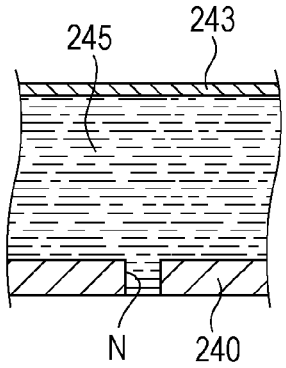
FIGS. 6A to 6C are explanatory diagrams for describing change in cross-sectional shape of the ejection unit when a driving signal is supplied.
Figure 6B:
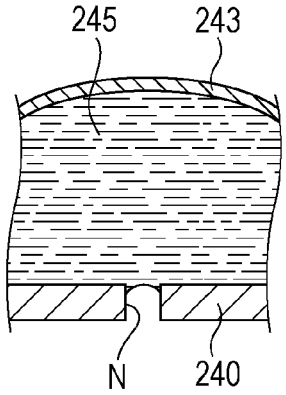
Figure 6C:
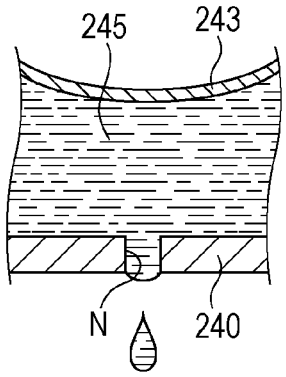

When the driving signal Vin is supplied to the piezoelectric element 200 illustrated in FIG. 3 from the driving signal generation unit 51, a Coulomb force is generated between electrodes, the vibration plate 243 is curved toward the upper direction in FIG. 3 with respect to the initial state illustrated in FIG. 6A, and the volume of the cavity 245 expands as illustrated in FIG. 6B. In this state, when the voltage indicated by the driving signal Vin is changed due to the control of the driving signal generation unit 51, the vibration plate 243 is restored by an elastic restoring force and moves toward the lower direction over the position of the vibration plate 243 in the initial state, and the volume of the cavity 245 illustrated in FIG. 6C is rapidly contracted. At this time, some of the ink filling in the cavity 245 is ejected as ink droplets from the nozzles N communicating with the cavity 245 by the compressed pressure generated in the cavity 245.

The vibration plate 243 of the cavity 245 damping-vibrates, that is, residual vibrates until the subsequent ink ejecting operation starts after a series of ink ejecting operations are finished. It is assumed that the residual vibration of the vibration plate 243 has a natural vibration frequency determined by shapes of the nozzles N and the ink supplying opening 247, or an acoustic resistance r due to ink viscosity, an inertance m due to an ink weight within a flow path, and a compliance Cm of the vibration plate 243.

A calculation model of the residual vibration of the vibration plate 243 based on the assumption will be described.

Figure 7:
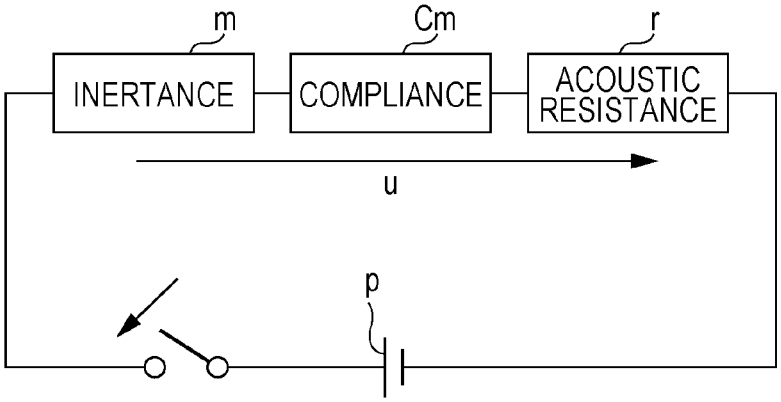
FIG. 7 is a circuit view illustrating a model of simple vibration indicating residual vibration in the ejection unit.

FIG. 7 is a circuit view illustrating the calculation model of simple harmonic vibration which assumes the residual vibration of the vibration plate 243.

As described above, the calculation model of the residual vibration of the vibration plate 243 is expressed by an acoustic pressure p, the aforementioned inertance m, acoustic resistance r and compliance Cm. Furthermore, if a step response is calculated for a volume velocity u when the acoustic pressure p is applied in the circuit of FIG. 7, the following equation is obtained.

$$u=\{p/(\omega\cdot m)\}e^{-\sigma t}\cdot\sin(\omega t)$$

$$\omega=\{1/(m\cdot Cm)-\alpha^2\}^{1/2}$$

$$\sigma=r/(2m)$$

Figure 8:
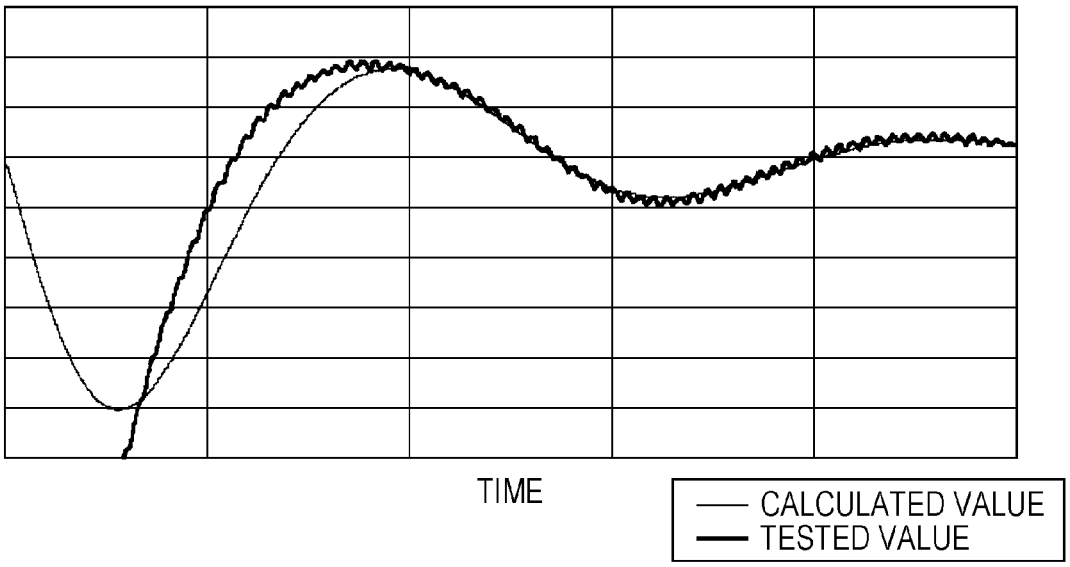
FIG. 8 is a graph illustrating a relationship between test values and calculated values of the residual vibration when the ejection state is normal in the ejection unit.

The calculation result obtained from the equation is compared with an experimental result in an experiment of the residual vibration of the vibration plate 243 after the ink droplets are separately ejected. FIG. 8 is a graph representing a relation between test values of the residual vibration of the vibration plate 243 and calculated values. As can be seen from the graph of FIG. 8, two waveforms of the test values and the calculated values roughly coincide.

In the ejection unit 35, a phenomenon where the ink droplets are not normally ejected from the nozzles N even though the ejecting operation described above is performed, that is, the ejection abnormality of the liquid droplets may occur. As a cause by which the ejection abnormality is generated, there are (1) mixing of bubbles into the cavity 245, (2) drying and thickening (adhering) of the ink in the vicinity of the nozzles N, and (3) attaching of paper powder in the vicinity of outlets of the nozzles N.

When the ejection abnormality is caused, as a result, the liquid droplets are not typically ejected from the nozzles N, that is, the non-ejection phenomenon of the liquid droplets is exhibited. In this case, dot omission of a pixel in an image printed on the recording paper P occurs. Moreover, when the ejection abnormality is caused, even though the liquid droplets are ejected from the nozzles N, the amount of the liquid droplets is too small, or a scattering direction (a trajectory) of the liquid droplets is deviated. Thus, since impact is not appropriately performed, the dot omission of the pixel appears. In this way, in the following description, the ejection abnormality of the liquid droplets is also referred to as "dot omission."

In the following description, based on the comparison result represented in FIG. 8, at least one value of the acoustic resistance r and the inertance m is adjusted so as to allow the calculated values of the residual vibration of the vibration plate 243 and the test values to match (roughly coincide) for each cause of the dot omission (ejection abnormality) phenomenon (liquid-droplet non-ejection phenomenon) occurring in the ejection unit 35 when the printing process is performed.

Figure 9:
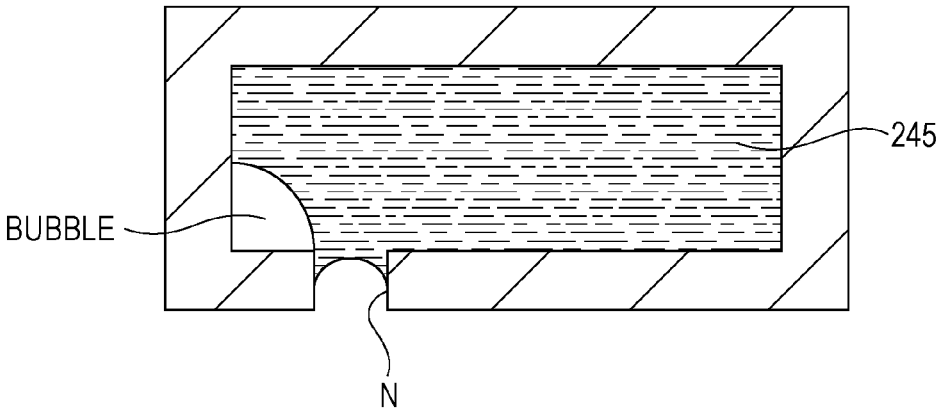
FIG. 9 is an explanatory diagram illustrating a state of the ejection unit when bubbles are mixed into the inside of a cavity.

Firstly, (1) the mixing of bubbles into the cavity 245 which is one cause of the dot omission is inspected. FIG. 9 is a conceptual view in the vicinity of the nozzles N when the bubbles are mixed into the cavity 245. As illustrated in FIG. 9, it is assumed that the generated bubbles are generated and attached to a wall surface of the cavity 245.

As mentioned above, when the bubbles are mixed into the cavity 245, it is considered that the total weight of the ink filled into the cavity 245 is reduced and the inertance m is decreased. Moreover, as exemplified in FIG. 9, when the bubbles are attached in the vicinity of the nozzles N, it is considered that diameters of the nozzles N become larger by as much as diameters of the bubbles and the acoustic resistance r is decreased.

Figure 10:
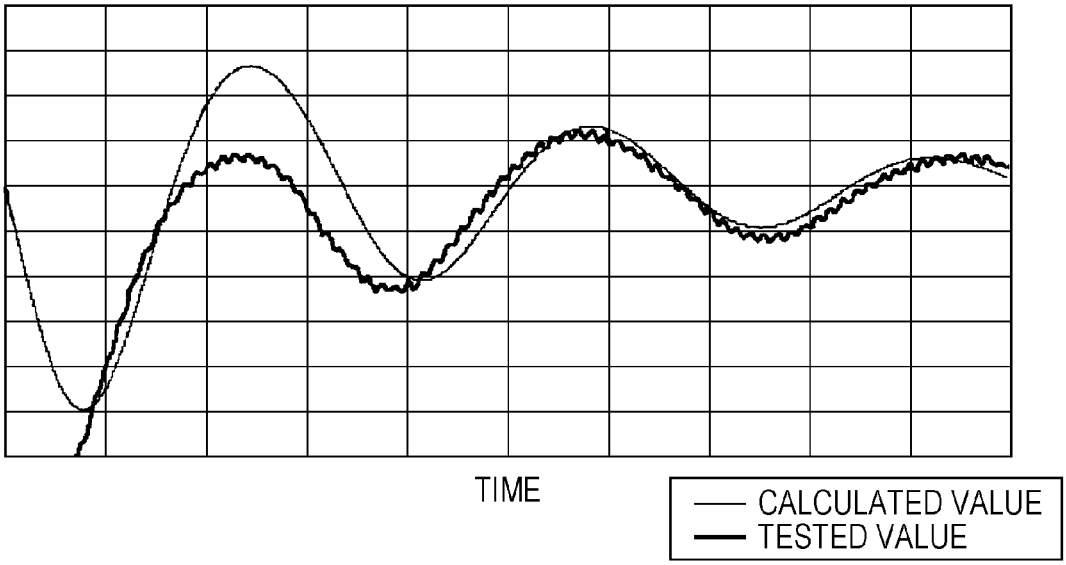
FIG. 10 is a graph illustrating test values and calculated values of the residual vibration in a state in which an ink cannot be ejected due to the mixture of bubbles into the inside of the cavity.

Accordingly, in the case of FIG. 8 where the ink is normally ejected, the acoustic resistance r and the inertance m are set to be small to match the test values of the residual vibration when the bubbles are mixed in, so that a result (a graph) represented in FIG. 10 is obtained. As can be seen from the graphs of FIGS. 8 and 10, when the bubbles are mixed into the cavity 245, a distinctive residual vibration waveform having a frequency higher than that in the case of normal ejection is obtained. Further, it can be seen that since the acoustic resistance r is decreased, a damping rate of an amplitude of the residual vibration is also decreased, so that the amplitude of the residual vibration is slowly decreased.

Figure 11:
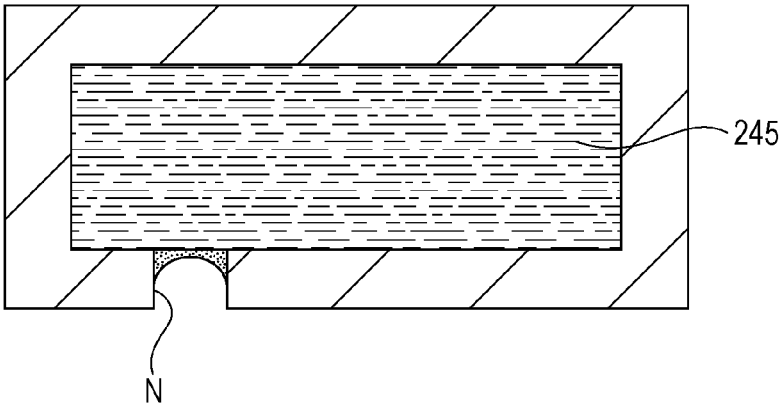
FIG. 11 is an explanatory diagram illustrating a state of the ejection unit when the ink is adhered to the vicinity of a nozzle.

Next, (2) the drying (fixation, thickening) of the ink in the vicinity of the nozzles N which is another cause of the dot omission is inspected. FIG. 11 is a conceptual view in the vicinity of the nozzles N when the ink in the vicinity of the nozzles N of FIG. 3 adheres by drying. As illustrated in FIG. 11, when the ink in the vicinity of the nozzles N is dried and adheres, the ink within the cavity 245 is enclosed within the cavity 245. As stated above, when the ink in the vicinity of the nozzles N is dried and thickened, it is considered that the acoustic resistance r is increased.

Figure 12:
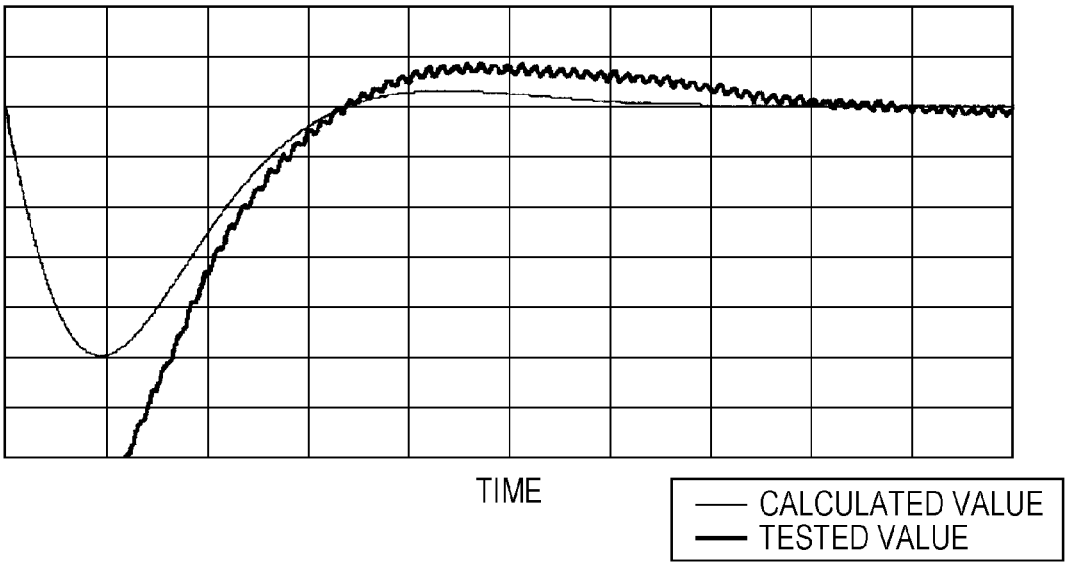
FIG. 12 is a graph illustrating test values and calculated values of the residual vibration in a state in which the ink cannot be ejected due to fixation of the ink to the vicinity of the nozzle.

Accordingly, in the case of FIG. 8 where the ink is normally ejected, the acoustic resistance r is set to be large to coincide with the test values of the residual vibration when the ink in the vicinity of the nozzles N is dried and adheres (thickened), so that a result (a graph) represented in FIG. 12 is obtained. Further, the test values represented in FIG. 12 are obtained by measuring the residual vibration of the vibration plate 243 while the ejection units 35 are placed without attaching caps for several days and the ink is not ejected (the ink adheres) by drying and thickening of the ink in the vicinity of the nozzles N. As can be seen from the graphs of FIGS. 8 and 12, when the ink adheres by drying of the ink in the vicinity of the nozzles N, the frequency is extremely decreased as compared to the normal ejection, and the distinctive residual vibration waveform in which the residual vibration is over-damped is obtained. This is because after the ink is allowed to flow into the cavity 245 from the reservoir by pulling the vibration plate 243 upwards in FIG. 3 in order to eject the ink droplets, since there is no retreat route of the ink within the cavity 245 at the time of moving the vibration plate 243 downwards in FIG. 3, it is difficult for the vibration plate 243 to rapidly vibrate (over-damping).

Figure 13:
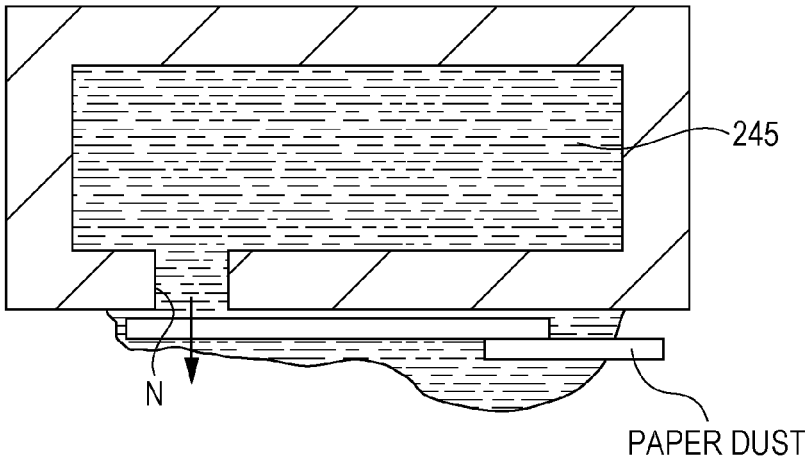
FIG. 13 is an explanatory diagram illustrating a state of the ejection unit in a case where paper dust is adhered to the vicinity of the outlet of the nozzle.

Next, (3) the attaching of paper powder in the vicinity of outlets of the nozzles N which is the other cause of the dot omission is inspected. FIG. 13 is a conceptual view in the vicinity of the nozzles N when the paper powder is attached in the vicinity of the nozzles N of FIG. 3. As illustrated in FIG. 13, when the paper powder is attached in the vicinity of the nozzles N, the ink is exuded from the inside of the cavity 245 through the paper powder, and it is difficult to eject the ink from the nozzles N. As stated above, when the paper powder is attached in the vicinity of the nozzles N and the ink is exuded from the nozzles N, since the ink within the cavity 245 and the exuded ink are more increased than that of the normal state when viewed from the vibration plate 243, it is considered that the inertance m is increased. Moreover, it is considered that the acoustic resistance r is increased by fibers of the paper powder attached to the outlets of the nozzles N.

Figure 14:
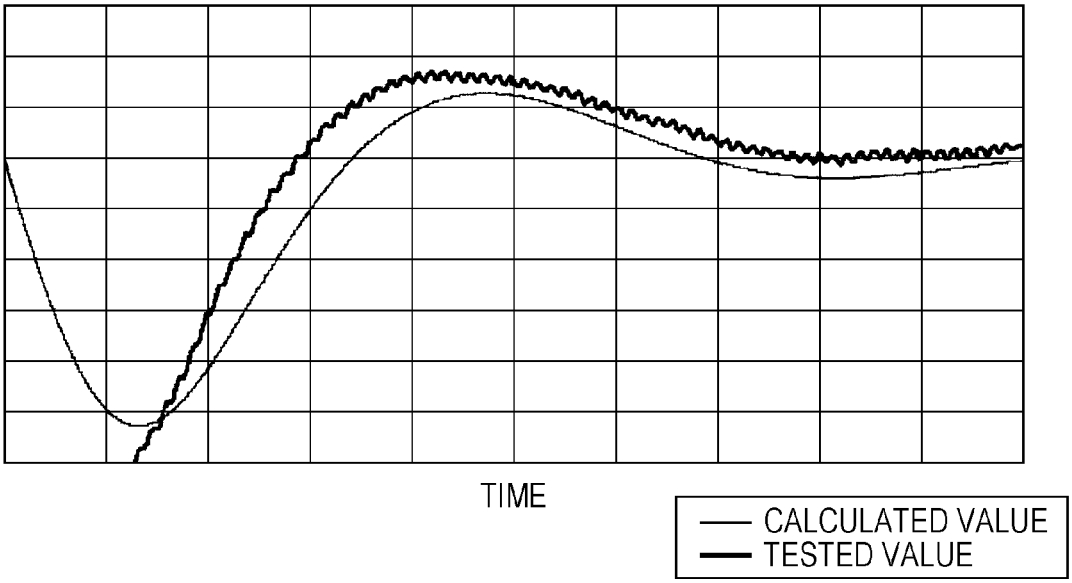
FIG. 14 is a graph illustrating test values and calculated values of the residual vibration in a state in which the ink cannot be ejected due to the adhesion of paper dust to the vicinity of the outlet of the nozzle.

Accordingly, in the case of FIG. 8 where the ink is normally ejected, the inertance m and the acoustic resistance r are set to be large to match the test values of the residual vibration when the paper powder is attached in the vicinity of the nozzles N, so that a result (a graph) of FIG. 14 is obtained. As can be seen from the graphs of FIGS. 8 and 14, when the paper powder is attached in the vicinity of the nozzles N, the distinctive residual vibration waveform having a frequency lower than that in the normal ejection is obtained.

Further, as can be seen from the graphs of FIGS. 12 and 14, when the paper powder is attached, the frequency of the residual vibration is higher than that when the ink is dried.

Here, the frequency of the residual vibrations when the ink in the vicinity of the nozzles N is dried and thickened and also when the paper powder is attached in the vicinity of the outlets of the nozzles N is lower than that when the ink is normally ejected. The causes of the two dot omission (ejection abnormality) can be distinguished by comparing the waveform of the residual vibration of the vibration plate 243, specifically, the frequency or the cycle of the residual vibration with the predetermined threshold value.

As is obvious from the above description, it is possible to determine the ejection state of the respective ejection units 35 based on the waveform of the residual vibration of the vibration plate 243 when the ink droplets are ejected from the nozzles N in the respective ejection units 35 and, particularly, the frequency or the cycle of the residual vibration. More specifically, based on the frequency or the cycle of the residual vibration, it is possible to determine whether the ejection state in the respective ejection units 35 is normal and to determine that which number (1) to (3) the cause of the ejection abnormality corresponds to when the ejection state in the respective ejection units 35 is abnormal.

The ink jet printer 1 according to the present embodiment operates the ejection state determining process of determining the ejection state by analyzing the residual vibration.

4. Configurations and Operations of Head Driver

Next, the configurations and the operations of the head driver 50 (the driving signal generation unit 51, the switching unit 53, and the ejection abnormality detection unit 52) will be described with reference to FIGS. 15 to 22.

Figure 15:
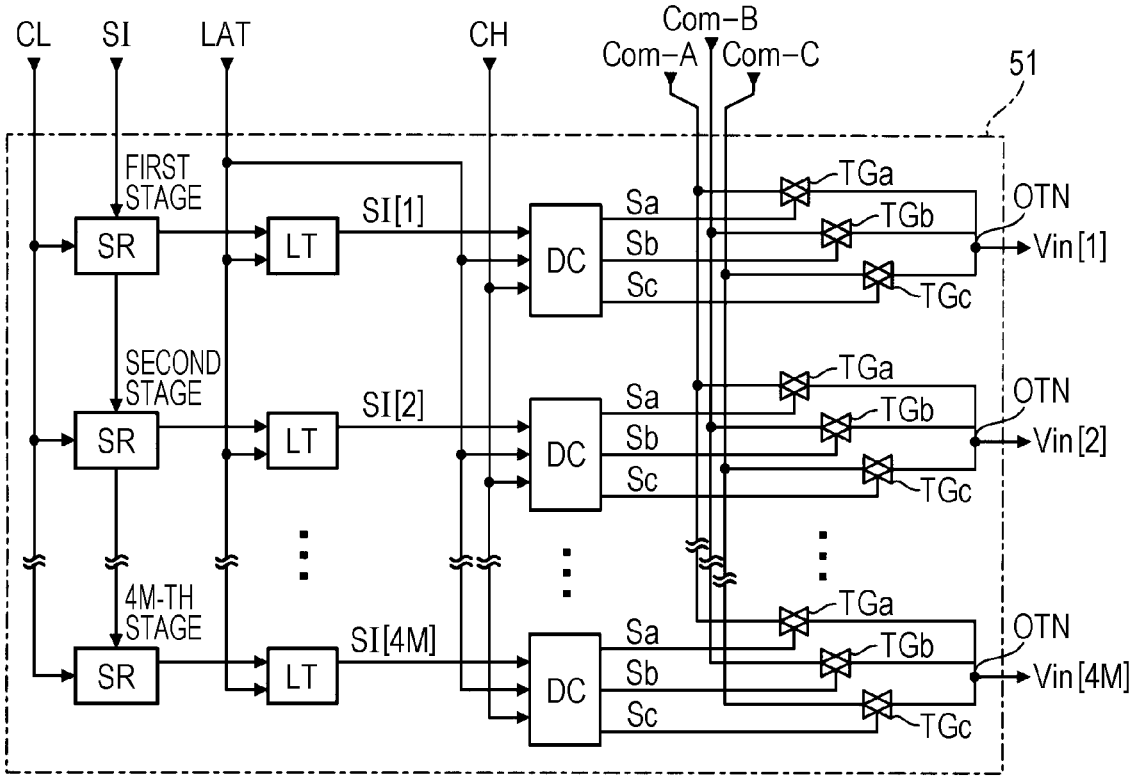
FIG. 15 is a block diagram illustrating the configuration of a driving signal generation unit.

FIG. 15 is a block diagram illustrating the configuration of the driving signal generation unit 51 of the head driver 50. As illustrated in FIG. 15, the driving signal generation unit 51 has 4M number of sets each including shift registers SR, latch circuits LT, decoders DC, and transmission gates TGa, TGb and TGc so as to be in a one-to-one correspondence with the 4M number of ejection units 35. In the following description, the respective parts constituting the 4M number of sets are referred to as a first stage, a second stage, . . . , and a 4M-th stage in sequence from the top in the drawing.

Further, although details will be described below, the ejection abnormality detection unit 52 includes 4M number of ejection abnormality detection circuits DT (DT[1], DT[2], . . . , and DT[4M]) so as to be in a one-to-one correspondence with the 4M number of ejection units 35.

Clock signals CL, printing signals SI, latch signals LAT, change signals CH, and driving waveform signals Com (Com-A, Com-B and Com-C) are supplied to the driving signal generation unit 51, from the control unit 6.

Here, the printing signal SI is a digital signal that defines the amount of ink ejected from the ejection unit 35 (the nozzles N) in forming one dot of an image. More specifically, the printing signals SI according to the present embodiment are signals that define the amount of inks ejected from the ejection units 35 by 3 bits of a high-order bit b1 a middle-order bit b2 and a low-order bit b3 and are serially supplied to the driving signal generation unit 51 in synchronization with the clock signals CL from the control unit 6. By controlling the amount of inks ejected from the ejection units 35 by the printing signals SI, it is possible to express four gradation steps of non-recording, a small dot, a medium dot and a large dot in the respective dots of the recording paper P, and it is possible to generate the residual vibration to generate the driving signal Vin for inspection for inspecting the ejection state of the ink.

The shift registers SR temporarily hold the printing signals SI of 3 bits corresponding to the ejection units 35. Specifically, the 4M number of shift registers SR having the first stage, the second stage, . . . , and the 4M-th stage in a one-to-one correspondence with the 4M number of ejection units 35 are cascade-connected to each other, and the printing signals SI serially supplied are sequentially transferred to the subsequent stage in response to the clock signals CL. Furthermore, the supply of the clock signals CL is stopped at a point of time when the printing signals SI are transferred to all of the 4M number of shift registers SR, and each of the 4M number of shift registers SR maintains a state where each shift register holds data of 3 bits corresponding to each shift register among the printing signals SI.

The 4M number of latch circuits LT simultaneously latch the printing signals SI of 3 bits corresponding to the respective stages held by the respective 4M number of shift registers SR at a timing when the latch signals LAT rise. In FIG. 15, SI[1], SI[2], . . . , SI[4M] are the printing signals SI of 3 bits latched by the latch circuits LT corresponding to the shift registers SR of first, second, . . . and 4M stages.

On the other hand, the operation period which is a period for which the ink jet printer 1 operates at least one process among the printing process, the ejection state determining process, and the determination criteria decision process is formed of a plurality of unit operation periods Tu. The respective unit operation periods Tu are formed of the control period Ts1 and the control period Ts2 which follows the control period Ts1. In the present embodiment the control periods Ts1 and Ts2 have an equivalent time length to each other.

In addition, in the present embodiment, a plurality of unit operation periods Tu constituting the operation period are classified into four unit operation periods Tu, which are a unit operation period Tu for which the printing process is performed, a unit operation period Tu for which the ejection state determining process is performed, a unit operation period Tu for which the determination criteria decision process is performed, and a unit operation period Tu for which both processes of the printing process and the ejection state determining process are performed.

In this case, the plurality of unit operation period Tu constituting the operation period may be formed of three kinds of unit operation periods Tu of the unit operation period Tu for which the printing process is performed, the unit operation period Tu for which the ejection state determining process is performed, and the unit operation period Tu for which the determination criteria decision process is performed.

The control unit 6 supplies the printing signals SI during each unit operation period Tu to the driving signal generation unit 51, and controls the driving signal generation unit 51 to allow the latch circuits LT to latch the printing signals SI[1], SI[2], . . . , SI[4M] during each unit operation period Tu. That is, the control unit 6 controls the driving signal generation unit 51 to supply the driving signals Vin to the 4M number of ejection unit 35 during each unit operation period Tu.

More specifically, in a case where the control unit 6 controls the driving signal generation unit 51 such that the driving signal Vin for printing is supplied to the 4M number of ejection units 35 in a case where the printing process is performed in the unit operation period Tu. Accordingly, the 4M number of ejection units 35 eject the ink with an amount according to image data Img and an image corresponding to the image data Img is formed on recording paper P.

The control unit 6 controls the driving signal generation unit 51 such that the driving signal Vin is supplied to the 4M number of the ejection units 35 in a case where only the ejection state determining process is performed in the unit operation period Tu.

Further, the control unit 6 controls the driving signal generation unit 51 such that the driving signal Vin for printing is supplied to a part of the 4M number of ejection units 35 and the driving signal Vin for inspection is supplied to the remaining ejection units 35 in a case where both of the printing process and the ejection state determining process are performed in the unit operation period Tu.

Moreover, the control unit 6 controls the driving signal generation unit 51 such that the driving signal Vin for inspection is supplied to the 4M number of ejection units 35 even in a case where the determination criteria decision process is performed in the unit operation period Tu.

The decoder DC decodes the printing signal SI of 3 bits latched by the latch circuit LT, and outputs selection signals Sa, Sb and Sc during each of the control periods Ts1 and Ts2.

FIG. 16 is an explanatory diagram (a table) illustrating decoding performed by the decoder DC. As illustrated in the drawing, when the printing signals SI[m] corresponding to the m stages (m is a natural number which satisfies $1 \leq m \leq 4M$) indicate, for example, (b1, b2, b3)=(1, 0, 0), the decoders DC of M stages set the selection signal Sa to a high level H and set the selection signals Sb and Sc to a low level L during the control period Ts1. In addition, the decoders set the selection signals Sb to a high level H and set the selection signal Sa and Sc to a low level L during the control period Ts2.

Moreover, when the low-order bit b3 is "1," that is, (b1, b2, b3)=(0, 0, 1), the decoders DC of m stages set the selection signals Sc to a high level H and set the selection signal Sa and Sb to a low level L during the control periods Ts1 and Ts2.

The description returns to FIG. 15.

As illustrated in FIG. 15, the driving signal generation unit 51 includes 4M number of sets including transmission gates TGa, TGb and TGc. The 4M number of sets including transmission gates TGa, TGb and TGc are provided in a one-to-one correspondence with the 4M number of ejection units 35.

The transmission gate TGa is turned on when the selection signal Sa is in a high level H, and is turned off when the selection signal Sa is in a low level L. The transmission gate TGb is turned on when the selection signal Sb is in a high level H, and is turned off when the selection signal Sb is in a low level L. The transmission gate TGc is turned on when the selection signal Sc is in a high level H, and is turned off when the selection signal Sc is in a low level L.

For example, in the m-th stage, when the content indicated by the printing signal SI[m] is (b1, b2, b3)=(1, 0, 0), the transmission gate TGa is turned on and the transmission gates TGb and TGc are turned off during the control period Ts1, and the transmission gate TGb is turned on and the transmission gates TGb and TGc are turned off during the control period Ts2.

The driving waveform signal Com-A is supplied to one terminal of the transmission gate TGa, the driving waveform signal Com-B is supplied to one terminal of the transmission gate TGb, and the driving waveform signal Com-C is supplied to one terminal of the transmission gate TGc. Moreover, the other terminals of the transmission gates TGa, TGb and TGc are commonly connected to an output terminal OTN to the switching unit 53.

The transmission gates TGa, TGb and TGc are exclusively turned on, and the driving waveform signal Com-A, Com-B or Com-C selected for the control periods Ts1 and Ts2 are output to the m-th stage output terminal OTN, as the driving signals Vin[m], and supplied to the ejection unit 35 of the m-th stage through the switching unit 53.

Figure 17:
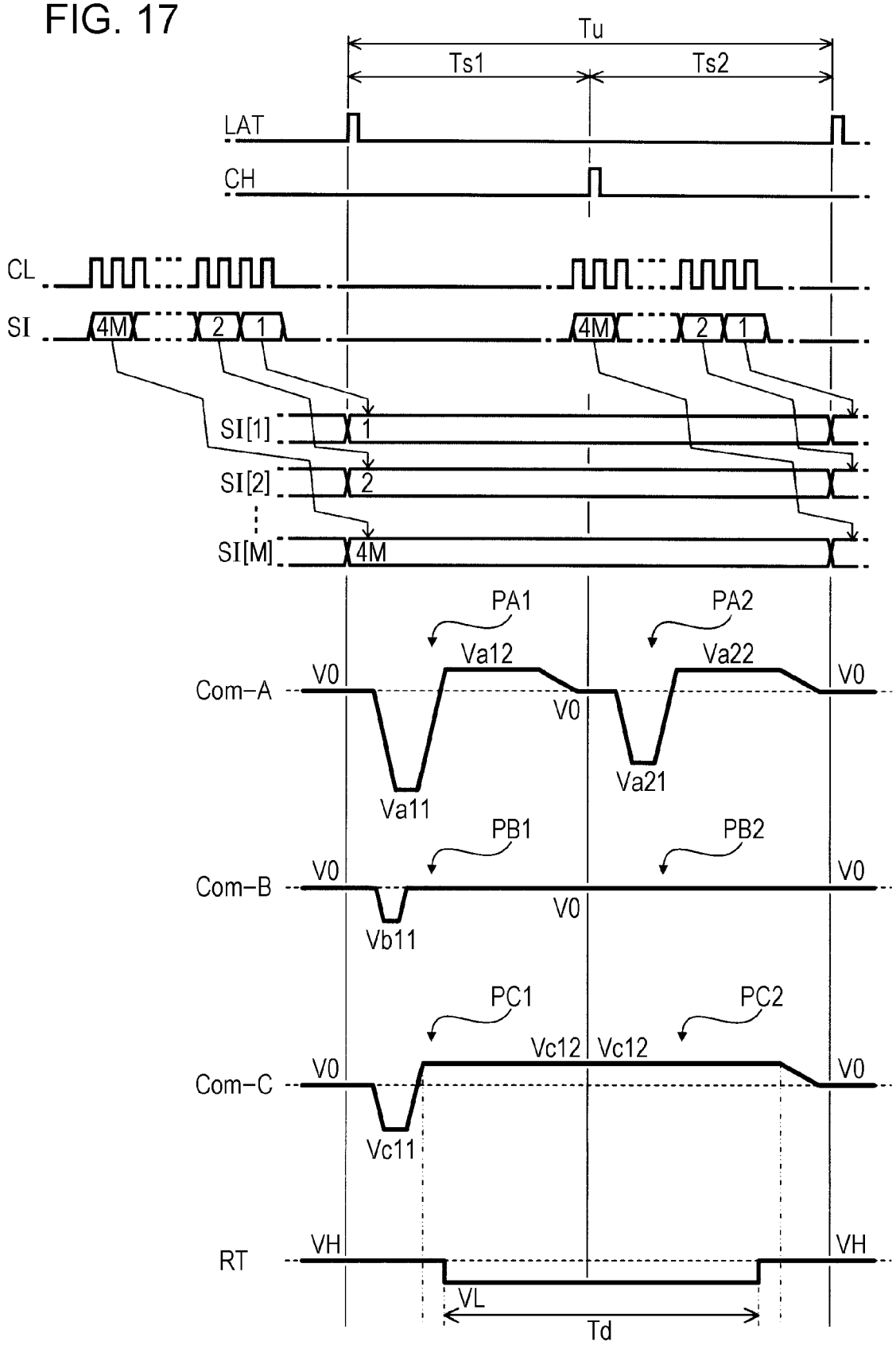
FIG. 17 is a timing chart illustrating an operation of the driving signal generation unit in a unit operation period.

FIG. 17 is a timing chart for describing the operation of the driving signal generation unit 51 during the unit operation period Tu. As illustrated in FIG. 17, the unit operation period Tu is defined by the latch signal LAT output from the control unit 6. Moreover, the control periods Ts1 and Ts2 included in the unit operation period Tu are defined by the latch signal LAT and the change signal CH output from the control unit 6.

The driving waveform signal Com-A supplied from the control unit 6 during the unit operation period Tu is a signal for generating the driving signal Vin for printing, and has a waveform that continuously connects a unit waveform PA1 disposed in the control period Ts1 of the unit operation period Tu and a unit waveform PA2 disposed in the control period Ts2 as illustrated in FIG. 17. Potentials at a timing when the unit waveform PA1 and the unit waveform PA2 start and end are both reference potentials V0. Moreover, a potential difference between a potential Va11 and a potential Va12 of the unit waveform PA1 is larger than a potential difference between a potential Va21 and a potential Va22 of the unit waveform PA2. For this reason, the amount of the ink ejected from the nozzles N included in the ejection unit 35 when the piezoelectric elements 200 included in the ejection unit 35 are driven by the unit waveform PA1 is larger than the amount of the ink ejected when the piezoelectric elements are driven by the unit waveform PA2.

The driving waveform signal Com-B supplied from the control unit 6 during the unit operation period Tu is a signal for generating the driving signal Vin for printing, and has a waveform that continuously connects a unit waveform PB1 disposed in the control period Ts1 and a unit waveform PB2 disposed in the control period Ts2 . Potentials at a timing when the unit waveform PB1 starts and ends are both reference potentials V0, and the unit waveform PB2 is maintained at the reference potential V0 over the control period Ts2 . Moreover, a potential difference between a potential Vb11 of the unit waveform PB1 and a reference potential V0 is smaller than a potential difference between a potential Va21 and a potential Va22 of the unit waveform PA2. In addition, even when the piezoelectric elements 200 included in the ejection unit 35 are driven by the unit waveform PB1, the ink is not ejected from the nozzles N included in the ejection unit 35. Similarly, even when the unit waveform PB2 is supplied to the piezoelectric elements 200, the ink is not ejected from the nozzles N.

The driving waveform signal Com-C supplied from the control unit 6 during the unit operation period Tu is a signal for generating the driving signal Vin for inspection, and has a waveform that continuously connects a unit waveform PC1 disposed in the control period Ts1 and a unit waveform PC2 disposed in the control period Ts2 . The unit waveform PC1 is changed from the reference potential V0 to a potential Vc11, and is then changed from the potential Vc11 to a potential Vc12. Thereafter, the potential of the unit waveform PC1 is maintained at the potential Vc12 until the control period Ts1 ends. Moreover, the potential of the unit waveform PC2 is maintained at the potential Vc12, and is then changed from the potential Vc12 to the reference potential V0 before the control period Ts2 ends.

In the present embodiment, the potential difference between the potential Vc11 and the potential Vc12 in the unit waveform PC1 is smaller than the potential difference between the potential Va21 and the potential Va22 in the unit waveform PA2, and is set to a potential such that the ink is not ejected from the ejection unit 35 in a case where the ejection unit 35 is driven by the driving signal Vin for inspection having the unit waveform PC1.

That is, in the present embodiment, the ejection state determining process assumes so-called "non-ejection inspection" in which the ejection state of the ink in the ejection unit 35 is determined based on the residual vibration generated in the ejection unit 35 when the ejection unit 35 is driven such that the ink is not ejected.

However, the invention is not limited thereto, and the ejection state determining process may be so-called "ejection inspection" in which the ejection state of the ink in the ejection unit 35 is determined based on the residual vibration in the ejection unit 35 when the ejection unit 35 is driven such that the ink is not ejected.

In a case where the ejection state determining process is performed by ejection inspection, since the ink is ejected from the ejection unit 35, it is preferable that at least one of the heat unit 30 and the recording paper P be moved to a location at which the ink does not impact on the recording paper P even when the ink is ejected from the ejection unit 35 and then the ejection state determining process be performed. That is, in a case where the ejection state determining process is the ejection inspection, it is preferable that the ejection state determining process be performed only in the unit operation period Tu for which the printing process is not performed.

As illustrated in FIG. 17, the 4M number of latch circuits Lt output the printing signals SI[1], SI[2], . . . , and SI[4M] at a timing when the latch signals LAT rise, that is, at a timing when the unit operation period Tu starts.

Further, the m-th stage decoder DC outputs selection signals Sa, Sb, and Sc based on the contents of the table illustrated in FIG. 16 in respective control periods Ts1 and Ts2 according to the printing signal SI[m] as described above.

Moreover, as described above, the transmission gates TGa, TGb and TGc of the m-th stage select any one of the driving waveform signals Com-A, Com-B and Com-C based on the selection signals Sa, Sb, and Sc, and output the selected driving waveform signal Com as the driving signal Vin[m].

Further, a switching period designation signal RT illustrated in FIG. 17 is a signal that defines a switching period Td. The switching period designation signal RT and the switching period Td will be described below.

Figure 18:
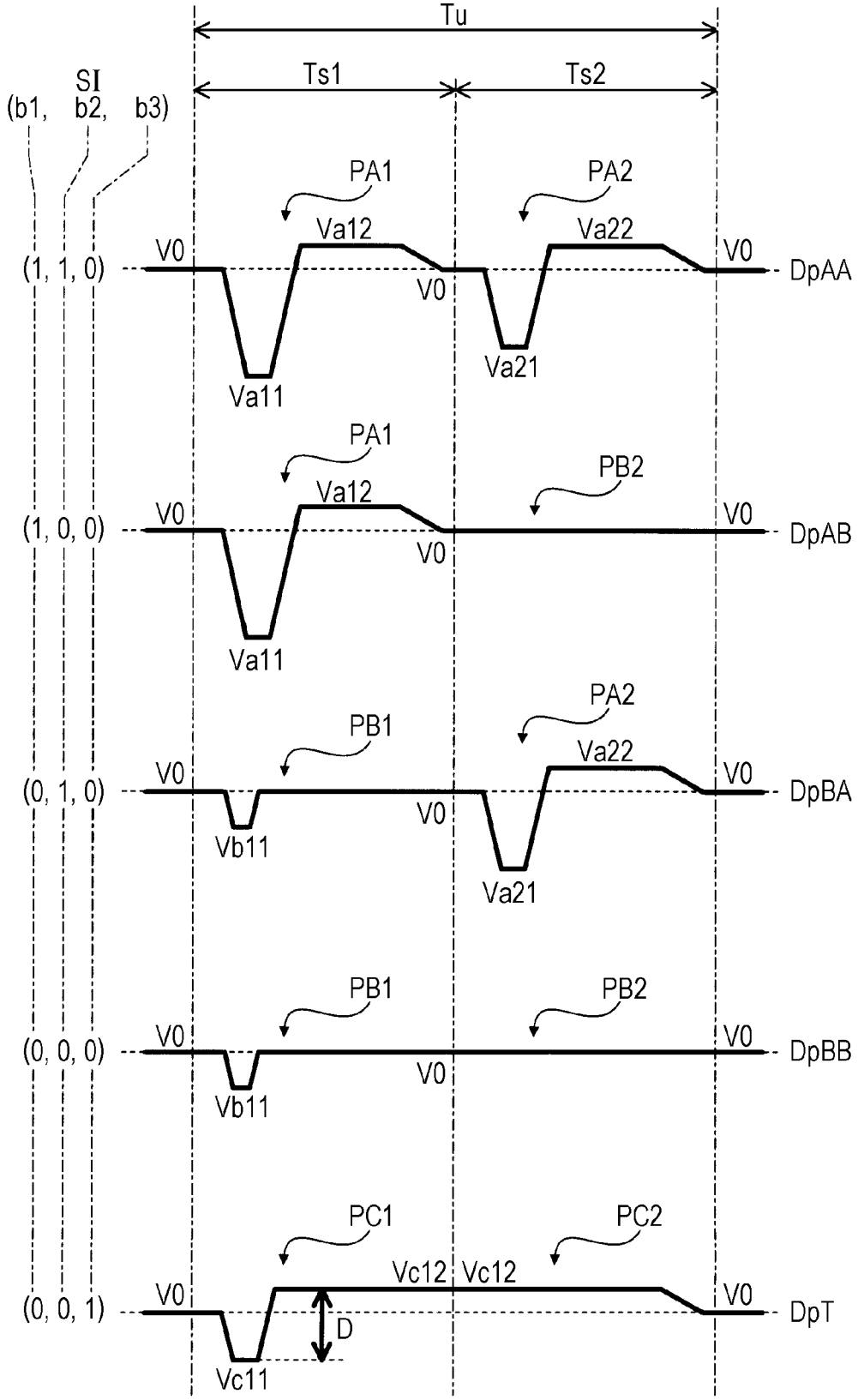
FIG. 18 is a timing chart illustrating a waveform of a driving signal in the unit operation period.

A waveform of the driving signal Vin output from the driving signal generation unit 51 during the unit operation period Tu will be described with reference to FIG. 18 in addition to FIGS. 15 to 17.

Since the printing signal SI[m] supplied during the unit operation period Tu indicates (b1, b2, b3)=(1, 1, 0), since the selection signals Sa, Sb and Sc are in a high level H, a low level L, and a low level L during the control period Ts1 , the driving waveform signal Com-A is selected by the transmission gate TGa, and the unit waveform PA1 is output as the driving signal Vin[m]. Similarly, during the control period Ts2 , the driving waveform signal Com-A is selected, and the unit waveform PA2 is output as the driving signal Vin[m]. Accordingly, in this case, the driving signal Vin[m] supplied to the ejection unit 35 of the m-th stage during the unit operation period Tu is the driving signal Vin for printing, and as illustrated in FIG. 18, a waveform thereof is a waveform DpAA including the unit waveform PA1 and the unit waveform PA2. As a result, during the unit operation period Tu, the ejection unit 35 of the m-th stage performs ejection of the medium amount of ink based on the unit waveform PA1 and ejection of the small amount of ink based on the unit waveform PA2, and the inks ejected twice are united on recording paper P, so that a large dot is formed on the recording paper P.

That is, when the printing signal SI[m] indicates (b1, b2, b3)=(1, 0, 0), since the driving waveform signal Com-A is selected during the control period Ts1 and the driving waveform signal Com-B is selected during the control period Ts2 , the driving signal Vin[m] supplied to the ejection unit 35 of the m-th stage during the unit operation period Tu is the driving signal Vin for printing, and a waveform thereof is a waveform DpAB including the unit waveform PA1 and the unit waveform PB2. As a result, the ejection unit 35 of the m-th stage performs ejection of the medium amount of ink based on the unit waveform PA1 during the unit operation period Tu, so that a medium dot is formed on the recording paper P.

When the contents of the printing signal SI[m] supplied during the unit operation period Tu indicate (b1, b2, b3)=(0, 1, 0), since the driving waveform signal Com-B is selected in the control period Ts1 and the driving waveform signal Com-A is selected in the control period Ts2 , the driving signal Vin[m] supplied to the ejection unit 35 of the m-th stage in the unit operation period Tu and the waveform thereof is a waveform DpBA including the unit waveform PB1 and the unit waveform PA2. As a result, the ejection unit 35 of the m-th stage ejects the ink in a small amount based on the unit waveform PA2 in the unit operation period Tu and small dots are formed on the recording paper P.

When the contents of the printing signal SI[m] supplied during the unit operation period Tu indicate (b1, b2, b3)=(0, 0, 0), since the driving waveform signal Com-B is selected in the control period Ts1 and the control period Ts2 , the driving signal Vin[m] supplied to the ejection unit 35 of the m-th stage in the unit operation period Tu and the waveform thereof is a waveform DpBB including the unit waveform PB1 and the unit waveform PB2. As a result, the ink is not ejected from the ejection unit 35 of the m-th stage in the unit operation period Tu and dots are not formed on the recording paper P (becomes non-recording).

When the contents of the printing signal SI[m] supplied during the unit operation period Tu indicate (b1 b2 b3)=(0, 0, 1), since the driving waveform signal Com-C is selected in the control period Ts1 and the control period Ts2 , the driving signal Vin[m] supplied to the ejection unit 35 of the m-th stage in the unit operation period Tu is a driving signal Vin for inspection and the waveform thereof is a waveform DpT including the unit waveform PC1 and the unit waveform PC2.

Figure 19:
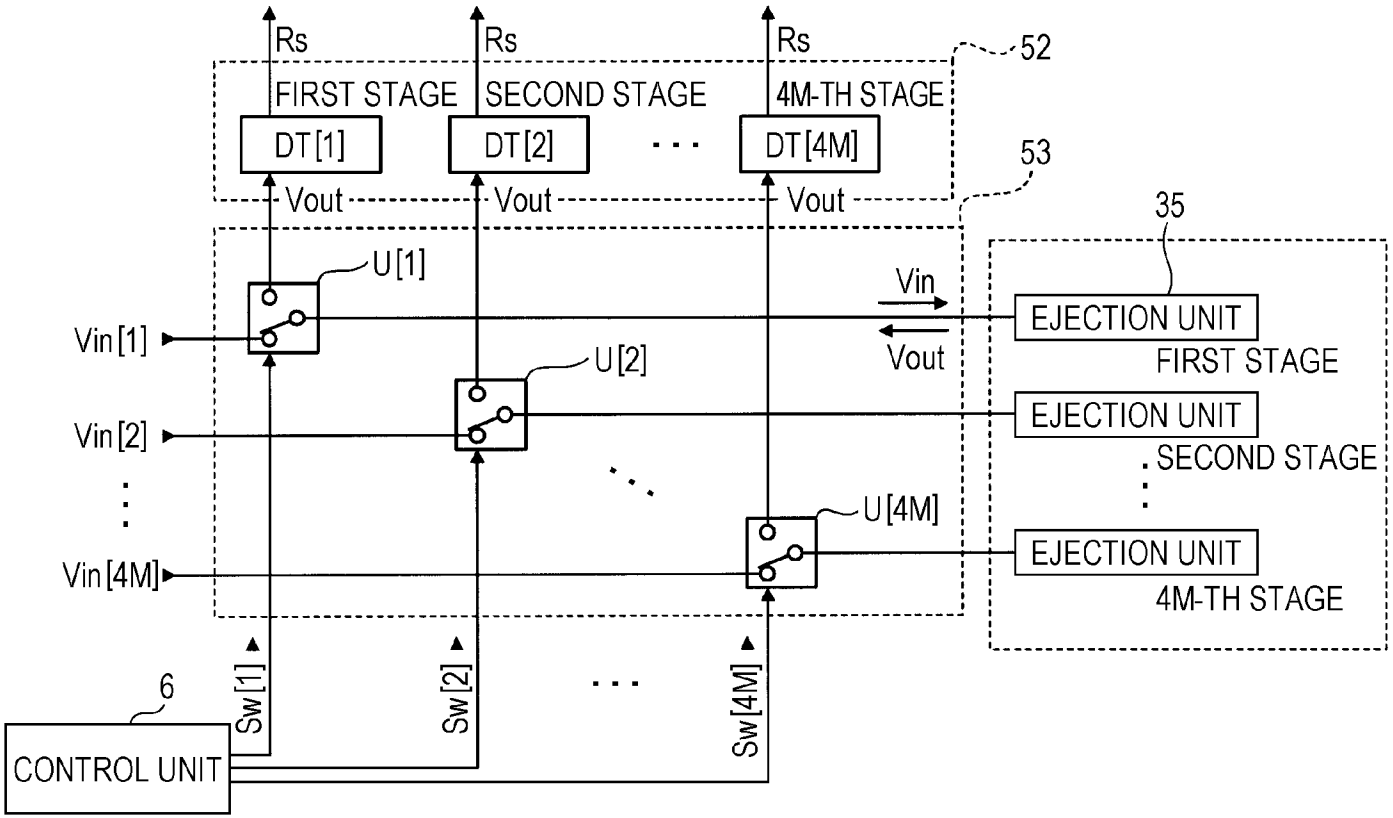
FIG. 19 is a block diagram illustrating the configuration of a switching unit.

FIG. 19 is a block diagram illustrating a configuration of the switching unit 53 of the head driver 50. In FIG. 19, electric connection relations between the switching unit 53, the ejection abnormality detection unit 52, the ejection unit 35, and the driving signal generation unit 51.

As illustrated in FIG. 19, the switching unit 53 includes 4M number of switching circuits U (U[1], U[2], . . . , and U[4M]) having first to 4M-th stages corresponding to the 4M number of ejection units 35. Moreover, the ejection abnormality detection unit 52 includes 4M number of ejection abnormality detection circuits DT (DT[1], DT[2], . . . , and DT[4M]) having first to 4M-th stages corresponding to the 4M number of ejection units 35.

The switching circuit U[m] of the m-th stage electrically connects the piezoelectric elements 200 of the ejection unit 35 of the m-th stage to any one of an output terminal OTN of the m-th stage included in the driving signal generation unit 51 and the ejection abnormality detection circuit DT[m] of the m-th stage included in the ejection abnormality detection unit 52.

In the following description, in the switching circuits U, a state where the ejection unit 35 and the output terminal OTN of the driving signal generation unit 51 are electrically connected is referred to as a first connection state. Moreover, a stage where the ejection unit 35 and the ejection abnormality detection circuit DT of the ejection abnormality detection unit 52 are electrically connected is referred to as a second connection state.

The control unit 6 outputs the switching control signals Sw for controlling the connection states of the switching circuits U to the switching circuits U.

Specifically, when the ejection unit 35 of the m-th stage is used to perform the printing process during the unit operation period Tu, the control unit 6 supplies the switching control signal Sw[m] to the switching circuit U[m] so as to allow the switching circuit U[m] corresponding to the ejection unit 35 of the m-th stage to maintain the first connection state over the entire period of the unit operation period Tu.

Meanwhile, when the ejection unit 35 of the m-th stage is a target of the ejection state determining process or the determination standard deciding process during the unit operation period Tu, the control unit 6 supplies the switching control signal Sw[m] to the switching circuit U[m] so as to allow the switching circuit U[m] corresponding to the ejection unit 35 of the m-th stage to enter the first connection state during a period other than the switching period Td of the unit operation period Tu and to enter the second connection state during the switching period Td of the unit operation period Tu. For this reason, the driving signal Vin is supplied to the ejection unit 35 which becomes the target of the ejection state determining process (or the determination standard deciding process) from the driving signal generation unit 51 during the period other than the switching period Td of the unit operation period Tu, and the residual vibration signal Vout is supplied to the ejection abnormality detection circuit DT from the ejection unit 35 during the switching period Td of the unit operation period Tu.

Further, as illustrated in FIG. 17, the switching period Td is a period during which the switching period designation signal RT generated by the control unit 6 is set to a potential VL. Specifically, the switching period Td is a period determined such that a period of the unit operation period Tu becomes a partial period or the entire period of a period during which the driving waveform signal Com-C (that is, the waveform DpT) maintains the potential Vc12.

The ejection abnormality detection circuit DT detects a change of electromotive force of the piezoelectric elements 200 of the ejection unit 35 to which the driving signal Vin for inspection is supplied during the switching period Td, as the residual vibration signal Vout.

In addition, the residual vibration signal Vout detected from the ejection unit in the edge portion is an example of the "first residual vibration signal," and the residual vibration signal Vout detected from the ejection unit in the center portion is an example of the "second residual vibration signal."

Figure 20:
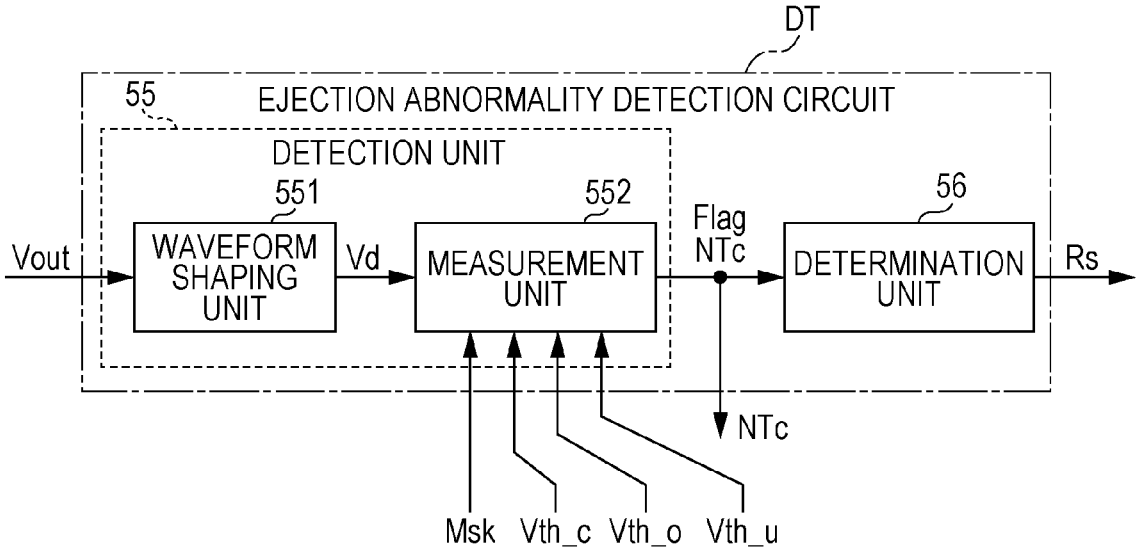
FIG. 20 is a block diagram illustrating the configuration of an ejection abnormality detection circuit.

FIG. 20 is a block diagram illustrating a configuration of the ejection abnormality detection circuit DT included in the ejection abnormality detection unit 52.

As illustrated in FIG. 20, the ejection abnormality detection circuit DT includes a detection unit 55 that outputs a detection signal NTc representing a time length corresponding to one cycle of the residual vibration of the ejection unit 35 based on the residual vibration signal Vout, and a determination unit 56 that determines the ejection state (that is, determine the presence of the ejection abnormality, and determine the causes of the ejection abnormality when the ejection abnormality is present) in the ejection unit 35 to output a determination result signal Rs representing the determination result.

Among them, the detection unit 55 includes a waveform shaping unit 551 that generates a shaping waveform signal Vd obtained by removing a noise component from the residual vibration signal Vout output from the ejection unit 35, and a measurement unit 552 that generates the detection signal NTc based on the shaping waveform signal Vd.

The waveform shaping unit 551 includes a high-pass filter for outputting a signal in which a low-band frequency component lower than a frequency band of the residual vibration signal Vout is damped, and a low-pass filter for outputting a signal in which a high-band frequency component is higher than the frequency band of the residual vibration signal Vout, and a configuration capable of limiting a frequency range of the residual vibration signal Vout to outputting the shaping waveform signal Vd from which the noise component is removed.

Moreover, the waveform shaping unit 551 may include a negative feedback type amplifier for adjusting the amplitude of the residual vibration signal Vout and a voltage follower for converting an impedance of the residual vibration signal Vout to output the shaping waveform signal Vd of a low impedance.

The shaping waveform signal Vd obtained by shaping the residual vibration signal Vout in the waveform shaping unit 551, a mask signal Msk generated by the control unit 6, a threshold potential Vth_c determined as a potential of an amplitude center level of the shaping waveform signal Vd, a threshold potential Vth_o determined as a high potential higher than the threshold potential Vth_c, and a threshold potential Vth_u determined as a low potential lower than the threshold potential Vth_c are supplied to the measurement unit 552. The measurement unit 552 outputs the detection signal NTc and an effective flag Flag indicating whether the detection signal NTc is an effective value.

Figure 21:
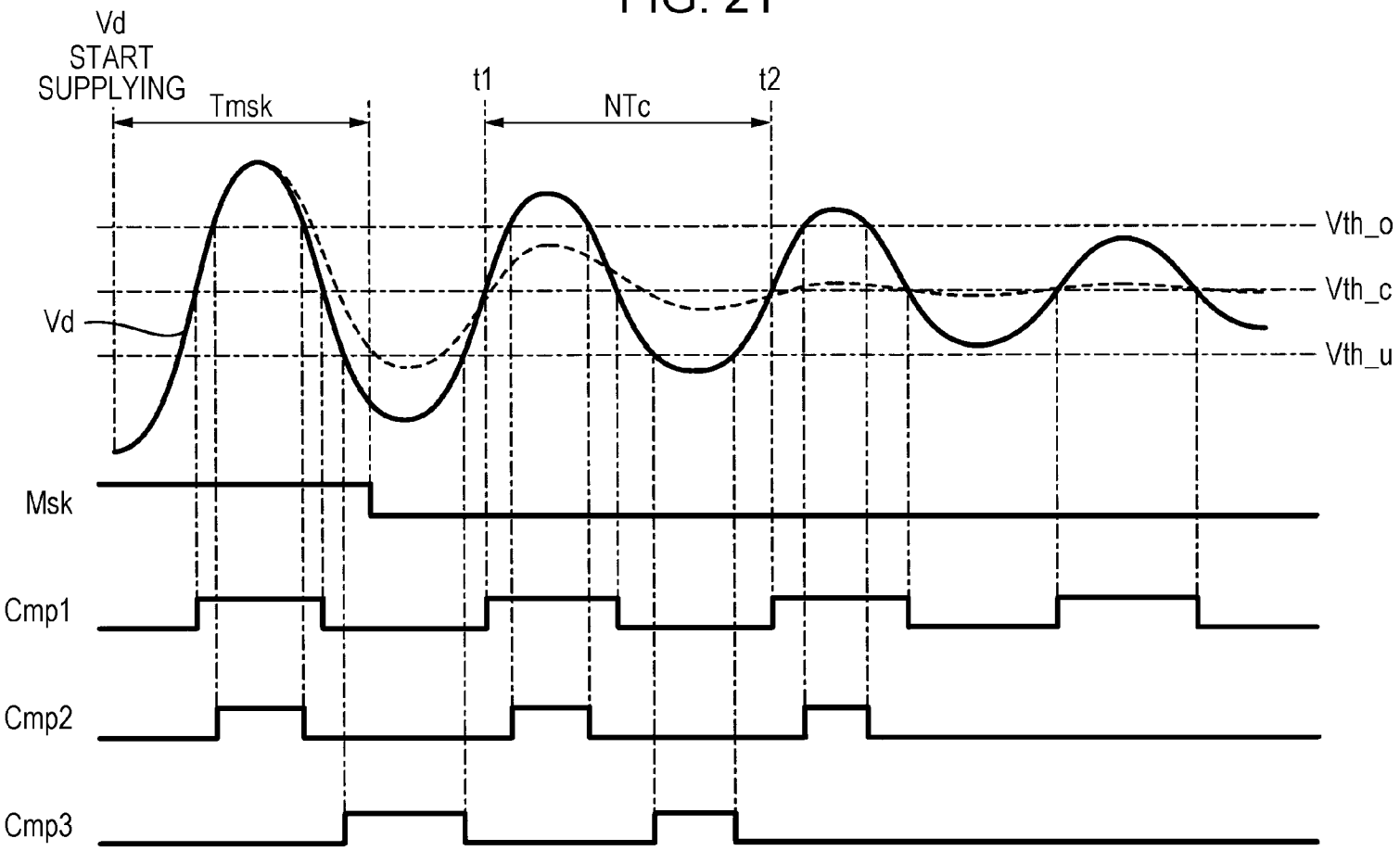
FIG. 21 is a timing chart illustrating an operation of the ejection abnormality detection circuit.

FIG. 21 is a timing chart illustrating an operation of the measurement unit 552.

As illustrated in the drawing, the measurement unit 552 compares a potential indicated by the shaping waveform signal Vd with the threshold potential Vth_c, and generates a comparison signal Cmp1 which is in a high level when the potential indicated by the shaping waveform signal Vd is equal to or more than the threshold potential Vth_c and is in a low level when the potential indicated by the shaping waveform signal Vd is less than the threshold potential Vth-c.

Moreover, the measurement unit 552 compares the potential indicated by the shaping waveform signal Vd with the threshold potential Vth_o, and generates a comparison signal Cmp2 which is in a high level when the potential indicated by the shaping waveform signal Vd is equal to or more than the threshold potential Vth_o and is in a low level when the potential indicated by the shaping waveform signal Vd is less than the threshold potential Vth_o.

Moreover, the measurement unit 552 compares the potential indicated by the shaping waveform signal Vd with the threshold potential Vth_u, and generates a comparison signal Cmp3 which is in a high level when the potential indicated by the shaping waveform signal Vd is less than the threshold potential Vth_u and is in a low level when the potential indicated by the shaping waveform signal Vd is equal to or more than the threshold potential Vth_u.

The mask signal Msk is a signal which is in a high level only during a predetermined period Tmsk after the supply of the shaping waveform signal Vd from the waveform shaping signal 551 is started. In the present embodiment, it is possible to obtain a high-accuracy detection signal NTc from which the superimposed noise components are removed immediately after the residual vibration starts by generating the detection signal NTc with only the shaping waveform signal Vd after the period Tmsk elapses as a target among the shaping waveform signals.

The measurement unit 552 includes a counter (not illustrated). After the mask signal Msk falls to a low level, the counter starts to count the clock signal (not illustrated) at a time t1 which is a timing when the potential indicated by the shaping waveform signal Vd is equal to the threshold potential Vth_c for the first time. That is, after the mask signal Msk falls to the low level, the counter starts to count at a time t1 which is an earlier timing to a timing when the comparison signal Cmp1 rises to a high level for the first time and a timing when the comparison signal Cmp1 falls to a low level for the first time.

In addition, after the counter starts, the counter stops counting the clock signal at a time t2 which is a timing when the potential indicated by the shaping waveform signal Vd becomes the threshold potential Vth_c for the second time, and outputs the obtained count value as the detection signal NTc. That is, after the mask signal Msk falls to the low level, the counter stops counting at a time t2 which is an earlier timing to a timing when the comparison signal Cmp1 rises to a high level for the second time and a timing when the comparison signal Cmp1 falls to a low level for the second time.

As stated above, the measurement unit 552 generates the detection signal NTc by measuring a time length from the time t1 to the time t2 as a time length corresponding to one cycle of the shaping waveform signal Vd.

Incidentally, when the amplitude of the shaping waveform signal Vd is small as indicated by a dashed line in FIG. 21, it is highly likely that it is difficult to accurately measure the detection signal NTc. Moreover, when the amplitude of the shaping waveform signal Vd is small, even though it is determined that the ejection state of the ejection unit 35 is normal based on only the result of the detection signal NTc, it is likely that the ejection abnormality may occur. For example, when the amplitude of the shaping waveform signal Vd is small, it is considered that since the ink is not injected into the cavity 245, it is difficult to eject the ink.

Here, in the present embodiment, it is determined whether the amplitude of the shaping waveform signal Vd has a magnitude sufficient to measure the detection signal NTc to output the determination result as the effective flag Flag.

Specifically, the measurement unit 552 outputs the effective flag Flag by setting a value of the effective flag Flag to a value "1" indicating that the detection signal NTc is effective when the potential indicated by the shaping waveform signal Vd is more than the threshold potential Vth_o and is less than the threshold potential Vth_u and by setting the value of the effective flag to "0" in the other cases during the period during which the counting is performed by the counter, that is, the period from the time t1 to the time t2. More specifically, the measurement unit 552 sets the value of the effective flag Flag to "1" when the comparison signal Cmp2 rises to the high level from the low level and then falls to the low level again and the compassion signal Cmp3 rises to the high level from the low level and then falls to the low level again during the period from the time t1 to the time t2, and sets the value of the effective flag Flag to "0."

In the present embodiment, since the measurement unit 552 determines whether the shaping waveform signal Vd has the amplitude of magnitude sufficient to measure the detection signal NTc in addition to generating the detection signal NTc indicating the time length corresponding to the one cycle of the shaping waveform signal Vd, it is possible to more accurately detect the ejection abnormality.

Further, the detection signal NTc output from the measurement unit 552 is supplied to the determination unit 56 and is also supplied to the control unit 6.

The determination unit 56 determines the ejection state of the ink in the ejection unit 35 based on the detection signal NTc and the effective flag Flag, and outputs the determination result as the determination result signal Rs.

FIG. 22 is an explanatory diagram for describing the determining of the determination unit 56. As illustrated in the drawing, the determination unit 56 compares a threshold value D1, a threshold value D2 representing a time length longer than the threshold value D1 and a threshold value D3 representing a time length longer than the threshold value D2.

Here, the threshold D1 is a value for indicating a boundary between a time length corresponding to one cycle of the residual vibration when the bubbles are generated within the cavity 245 to increase the frequency of the residual vibration and a time length corresponding to one cycle of the residual vibration when the ejection state is normal.

Moreover, the threshold value D2 is a value for indicating a boundary between a time length corresponding to one cycle of the residual vibration when the paper powder is attached in the vicinity of the nozzles N to decrease the frequency of the residual vibration and a time length corresponding to one cycle of the residual vibration when the ejection state is normal.

Moreover, the threshold value D3 is a value indicating a time length corresponding to one cycle of the residual vibration when the frequency of the residual vibration becomes further smaller than that when the paper powder is attached by adhering or thickening of the ink in the vicinity of the nozzles N and a time length corresponding to one cycle of the residual vibration when the paper powder is attached in the vicinity of the outlets of the nozzles N.

Further, in the following description, the threshold value D1, threshold value D2, and threshold value D3 can be referred to as "threshold value D."

Details will be described below, and the threshold values D (respective values of the threshold value D1, threshold value D2, and threshold value D3) are decided to have values which are different for each of the nozzle arrays and between the central ejection units and peripheral ejection units in the determination criteria decision process.

Hereinafter, the threshold value D1, the threshold value D2, and the threshold value D3 to be used in the ejection state determining process using a central ejection unit as an object are respectively referred to as a threshold value Da1, a threshold value Da2, and a threshold value Da3. In addition, the threshold value D1, the threshold value D2, and the threshold value D3 to be used in the ejection state determining process using a peripheral edge ejection unit as an object are respectively referred to as a threshold value Db1 a threshold value Db2 and a threshold value Db3.

As illustrated in FIG. 22, when the value of the effective flag Flag is "1" and satisfies "D1≤NTc≤D2," the determination unit 56 determines that the ejection state of the ink in the ejection unit 35 is normal, and sets the determination result signal Rs to a value "1" indicating that the ejection state is normal.

That is, in the present embodiment, with regard to the central ejection unit, in a case where a time length (that is, the cycle Tc) indicated by the detection signal NTc is in the range Ra which is more than or equal to the threshold value Da1 and less than or equal to the threshold value Da2 (see FIGS. 23A to 23C described below), it is determined that the ejection state of the ink in the central ejection unit is normal.

That is, in the present embodiment, with regard to the peripheral edge ejection unit, in a case where a time length (that is, the cycle Tc) indicated by the detection signal NTc is in the range Ra which is more than or equal to the threshold value Db1 and less than or equal to the threshold value Db2 (see FIGS. 23A to 23C described below), it is determined that the ejection state of the ink in the peripheral edge ejection unit is normal.

Moreover, when the value of the effective flag Flag is "1" and satisfies "NTc<D1," the determination unit 56 determines that the ejection abnormality occurs due to the bubbles generated in the cavity 245, and sets the determination result signal Rs to a value "2" indicating that the ejection abnormality occurs due to the bubbles.

Moreover, when the value of the effective flag Flag is "1" and satisfies "D2<NTc≤D3," the determination unit determines that the ejection abnormality occurs due to the paper powder attached in the vicinity of the outlets of the nozzles N, and sets the determination result signal Rs to a value "3" indicating that the ejection abnormality occurs due to the paper powder.

Moreover, when the value of the effective flag is "1" and satisfies "D3<NTc," the determination unit 56 determines that the ejection abnormality occurs due to the thickening of the ink in the vicinity of the nozzles N, and "4" indicating that the ejection abnormality occurs due to the thickening of the ink.

Moreover, when the value of the effective flag Flag is "0," the determination unit 56 sets the determination result signal to a value "5" indicating that the ejection abnormality occurs due to some causes such as non-injection of the ink, with respect to the determination result signal Rs.

As described above, the determination unit 56 determines the ejection state in the ejection unit 35, and outputs the determination result as the determination result signal Rs. For this reason, when the ejection abnormality occurs, the control unit 6 stops the printing process if necessary so that it is possible to perform an appropriate recovery process depending on the ejection abnormality indicated by the determination result signal Rs using the recovery mechanism 84.

5. Determination Criteria Decision Process

Next, general characteristics on distribution of the times (cycle Tc of the residual vibration generated in M number of ejection units 35) respectively indicated by the M number of detection signals NTc based on the M number of residual vibration signals Vout detected on the M number of the ejection unit 35 corresponding to the respective nozzle arrays will be described and the determination criteria decision process will be described.

Figure 23A:
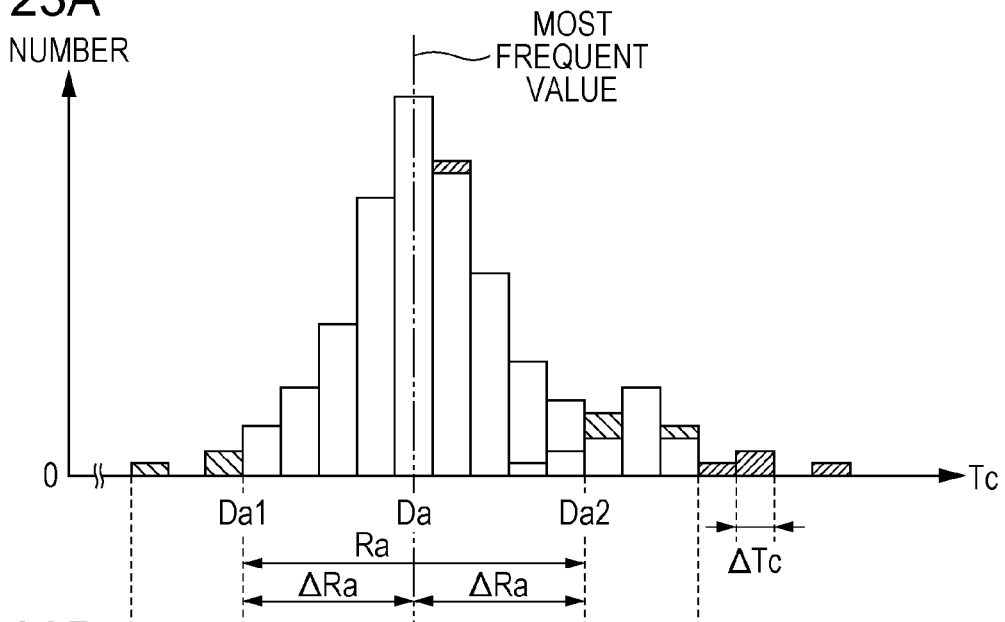
FIGS. 23A to 23C are histograms illustrating distribution of a cycle of the residual vibration generated in the ejection unit corresponding to respective nozzle arrays.
Figure 23B:
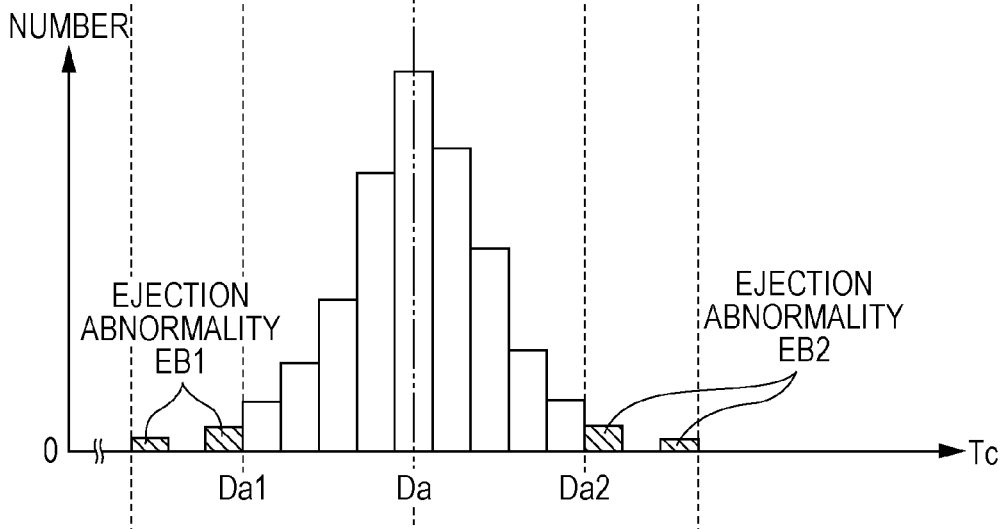
Figure 23C:
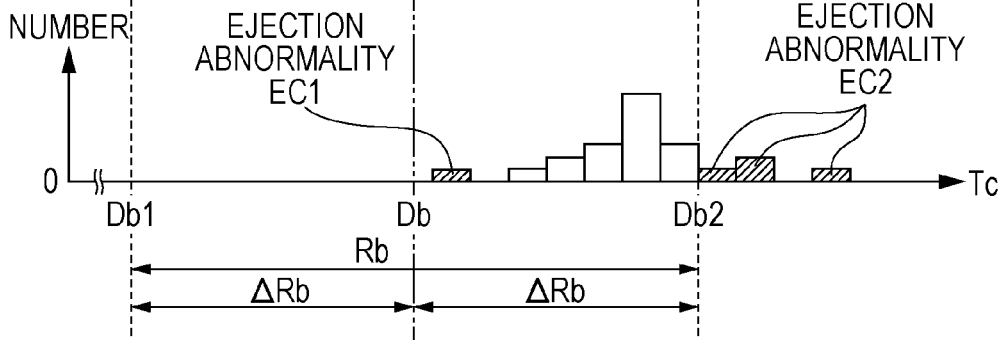

FIGS. 23A to 23C are histograms illustrating an example of distribution of values of the detection signals NTc (the cycle Tc of the residual vibration) based on the M number of residual vibration signals Vout detected on the M number of ejection units 35 corresponding to one nozzle array among 4 nozzle arrays included in the head unit 30. Specifically, in respective histograms illustrated in FIGS. 23A to 23C, the horizontal axis represents the cycle Tc (value of the detection signal NTc) detected from the respective ejection units 35 and the vertical axis represents the number of the ejection units 35 to which the residual vibration signal Vout illustrating the cycle Tc belonging to each segment is output when the cycle Tc is divided into each predetermined width ΔTc.

In addition, in FIGS. 23A to 23C, FIG. 23A is a histogram illustrating distribution of the cycle Tc on the M number of ejection units 35 corresponding to one nozzle array, FIG. 23B is a histogram illustrating distribution of the cycle Tc on α number of central ejection units among the M number of ejection units 35, and FIG. 23C is a histogram illustrating distribution of the cycle Tc on β number of peripheral edge ejection units among the M number of ejection units 35.

Moreover, examples illustrated in FIGS. 23A to 23C, a case where ejection abnormality occurs in a part of the M number of ejection units 35 is assumed, portions (portions EB1, EB2, EC1, and EC2) corresponding to the ejection units 35 in which the ejection abnormality occurs in the histograms illustrated in the figures are indicated by hatching, and portions corresponding to ejection units 35 with normal ejection state are illustrated by white outlined portions without hatching.

As illustrated in FIGS. 9 and 10, when ejection abnormality occurs in the ejection unit 35 by bubbles being mixed into the cavity 245, the cycle Tc of the residual vibration of the ejection unit 35 becomes shorter compared to the ejection unit 35 with normal ejection state. As illustrated in FIGS. 11 to 14, when ejection abnormality occurs in the ejection unit 35 due to thickening of the ink or paper dust adhered to the vicinity of the nozzles N, the cycle Tc of the residual vibration of the ejection unit 35 becomes longer compared to the ejection unit 35 with normal ejection state.

Accordingly, in principle, as illustrated in FIG. 23A, in the histogram illustrating the distribution of the cycle Tc on the M number of ejection units 35, it is likely that the ejection unit 35 with ejection abnormality appears in the vicinity of both ends (portion of the skirt of distribution). In other words, in principle, it is likely that the ejection unit 35 with ejection abnormality does not appear in the vicinity of the most frequent value of the histogram.

Therefore, it is considered that the ejection unit 35 whose ejection state is normal can be distinguished from the ejection unit 35 with ejection abnormality by setting the most frequent value in the histogram illustrated in FIG. 23A as a reference value Da and setting the range divided by the threshold value Da1 obtained by subtracting a difference constant ΔRa from the reference value Da and the threshold value Da2 obtained by adding the difference constant ΔRa to the reference value Da as the range Ra, and regarding the range Ra as a range in which the cycle Tc corresponding to the ejection unit 35 whose ejection state is normal is present.

However, a difference of the arranged positions on the head unit 30 or a difference of the structures is present between the central ejection unit and the peripheral edge ejection unit. Specifically, as illustrated in FIGS. 4 and 5, at least β1 number of ejection units 35 and β2 number of ejection units are provided on both sides (+X direction and −X direction) of the central ejection unit and at least β1 number of ejection units 35 and β2 number of ejection units are filled with the ink respectively, but only less than β1 number of ejection units 35 or less than β2 number of ejection units are provided on at least one of both sides of the peripheral edge ejection units (+X direction and −X direction), which is the difference between the central ejection units and the peripheral ejection units. Further, shapes or materials of the cavity 245 (cavity plate 242) are different between the central ejection unit and the peripheral edge ejection unit in some cases. The difference of compliance or acoustic resistance of the cavity 245 or the vibration plate 243 are generated between the central ejection unit and the peripheral ejection unit because of the difference of the arranged positions or the structures present between the central ejection unit and the peripheral edge ejection unit.

As a result, the cycle Tc of the residual vibration generated in the peripheral ejection unit tends to be longer than the cycle Tc of the residual vibration generated in the central ejection unit. That is, the Helmholtz resonance frequency of the peripheral ejection unit tends to be lower than the Helmholtz resonance frequency of the central ejection unit.

That is, as illustrated in FIGS. 23A to 23C, the distribution (FIG. 23C) of the cycle Tc on the β number of peripheral edge ejection unit becomes distribution right-sidedly distributed compared to the distribution (see FIG. 23A) of the cycle Tc on all of the M number of the ejection units 35 and the distribution (see FIG. 23B) of the cycle Tc on the α number of central ejection units. Accordingly, the distribution of the cycle Tc on ejection units 35 whose ejection state is normal in the β number of peripheral edge ejection units becomes distribution right-sidedly distributed compared to the distribution of the cycle Tc on the ejection units 35 whose ejection state is normal among the M number of the ejection units 35 and the distribution of the cycle Tc of the ejection units 35 whose ejection state is normal among the α number of central ejection units.

As a result, when the ejection state of the M number of ejection units 35 are determined based on whether the cycle Tc belongs to the range Rs, the correct determination on the peripheral ejection unit may not be possible even though correct determination was possible on the central ejection unit. For example, the state may be determined (erroneous determination) as ejection abnormality with respect to the peripheral ejection unit whose ejection state is normal.

Here, in the present embodiment, the ejection state of the central ejection unit is determined using the range Ra as a reference and the ejection state of the peripheral ejection unit is determined using the range Rb wider than the range Ra.

Specifically, as illustrated in FIG. 23C, the peripheral ejection unit whose election state is normal is distinguished from the peripheral ejection unit with occurrence of ejection abnormality by setting the most frequent value in the histogram illustrated in FIG. 23A as a reference value Db and setting the range divided by the threshold value Db1 obtained by subtracting a difference constant ΔRb, which is larger than the difference constant ΔRa, from the reference value Db and the threshold value Db2 obtained by adding the difference constant ΔRb to the reference value Db as the range Ra, and regarding the range Rb as a range in which the cycle Tc corresponding to the peripheral edge ejection unit whose ejection state is normal is present.

Accordingly, it is possible to realize the ejection state determining process in consideration of the cycle Tc of the residual vibration of the peripheral edge ejection unit being larger than that of the central ejection unit and to make accurate determination on the ejection state regarding both of the central ejection unit and the peripheral edge ejection unit.

Here, the above-described range Rb is an example of the "first range" and the range Ra is an example of the "second range."

Further, the difference constant ΔRa and the difference constant ΔRb may be predetermined constants.

In addition, the difference constant ΔRa and the difference constant ΔRb may be decided such that a ratio of the number of the ejection units 35 corresponding to the cycle Tc belonging to the range to the M number of ejection units 35 and a ratio of the number of ejection units 35 corresponding to the cycle Tc belonging to the range Rb to the M number of ejection units 35 are predetermined.

Next, the determination criteria decision process deciding the range Ra and the range Rb used as a reference of determination in the ejection state determining process will be described.

Figure 24:
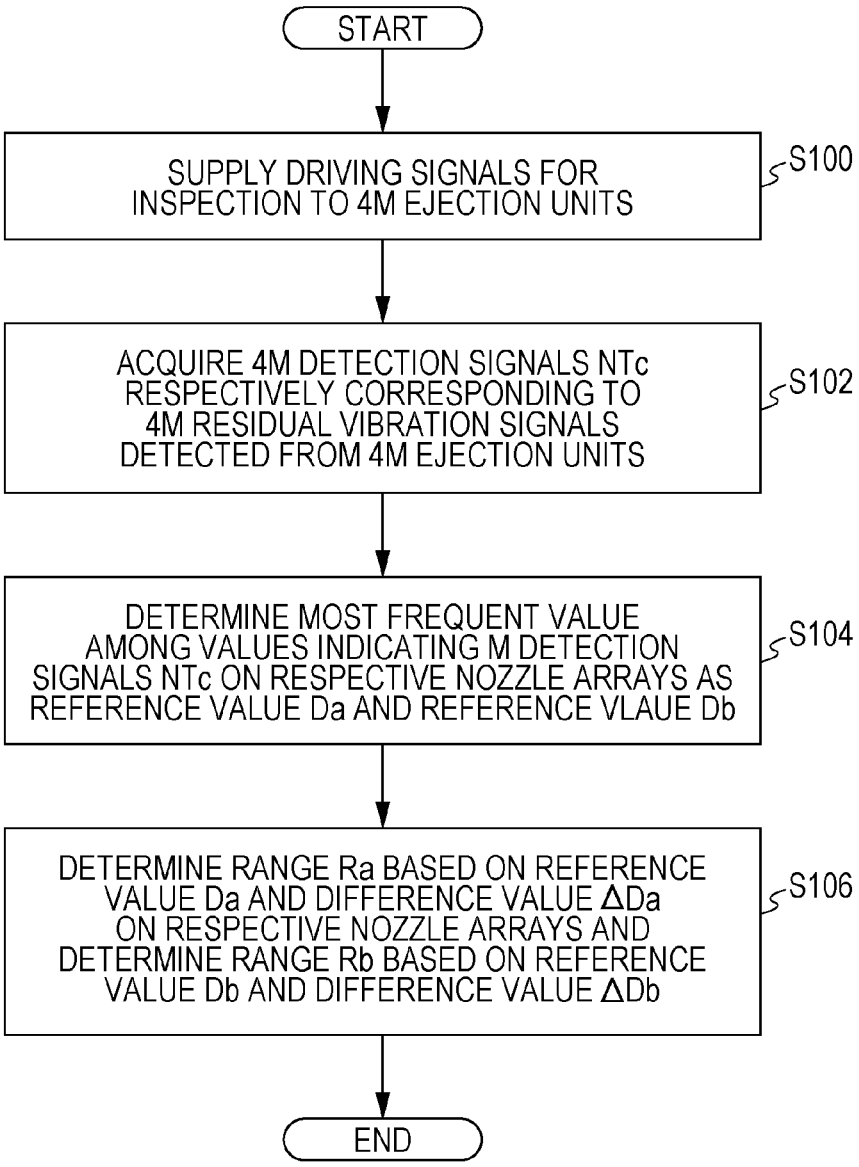
FIG. 24 is a flowchart illustrating an operation of the ink jet printer in a determination criteria decision process.

FIG. 24 is a flowchart illustrating an example of the operation of the ink jet printer 1 in the determination criteria decision process. The determination criteria decision process illustrated in the flowchart is performed at the time of, for example, initial setting and starting up the power of the ink jet printer 1, or warming-up before the ink jet printer 1 operates the printing process.

In the determination criteria decision process, firstly, the CUP 61 of the control unit 6 supplies the driving signal Vin for inspection to 4M number of ejection units 35 (Step S100).

Next, the CPU 61 acquires the 4M number of detection signals NTc generated by the ejection abnormality detection unit 52 based on the 4M number of residual vibration signals Vout respectively output from the 4M ejection units 35 to which the driving signal Vin for inspection is supplied (Step S102).

Subsequently, the CUP 61 decides the most frequent value indicated by the M number of detection signals NTc corresponding to the M number of ejection units 35 in the respective nozzle arrays in each of the 4 nozzle arrays as the reference value Da and the reference value Db (Step S104).

Further, in the histogram illustrated in FIGS. 23A to 23C, the cycle Tc is divided to each of predetermined widths ΔTc. Accordingly, in the histogram, the most frequent value of the cycle Tc is represented as a segment having the predetermined width ΔTc. Here, in the present embodiment, the reference value Da and the reference value Db may be decided as arbitrary values belonging to the segment of the predetermined width ΔTc representing the most frequent value. For example, the center value of the segment representing the most frequent value may be decided as the reference value Da and the reference value Db.

Next, the CUP 61 decides the range Ra by setting the value in which the difference value ΔRa is subtracted from the reference value Da as the threshold value Da1 and setting the value in which the difference constant ΔRa is added to the reference value Da as the threshold value Da2, and decides the range Rb by setting the value in which the difference value ΔRb is subtracted from the reference value Db as the threshold value Db1 and setting the value in which the difference constant ΔRb is added to the reference value Db as the threshold value Db2 in each of 4 nozzle arrays (Step S106).

Here, as described above, the difference constant ΔRb is set to be larger than the difference constant ΔRa.

Moreover, although not illustrated in FIGS. 23 and 24, the threshold value D3 (threshold values Da3 and Db3) may be decided in the determination criteria decision process. For example, the threshold value Da3 may be decided by adding the predetermined value (for example, a value of constant multiple of the difference constant ΔRa) to the reference value Da. Similarly, the threshold value Db3 may be decided by adding the predetermined value (for example, a value of constant multiple of the difference constant ΔRb) to the reference value Db.

6. Conclusion of First Embodiment

In this manner, in the present embodiment, in the determination criteria determining process, the ranges Ra and Rb are decided based on the distribution of the cycle Tc of the residual vibration on the M number of ejection units 35 corresponding to respective nozzle arrays. In addition, in the ejection state determining process, determination on the ejection state of the central ejection unit is made based on the range Ra and determination on the ejection state of the peripheral ejection unit is made based on the range Rb. Accordingly, it is possible to accurately determine the ejection state on the peripheral ejection unit in addition to the central ejection unit.

Moreover, in the present embodiment, the determination criteria decision process may be performed at the time of starting up the power of the ink jet printer 1 and performing the printing process.

Therefore, even in a case where the range of the cycle Tc whose ejection state of the ejection unit 35 is normal is changed due to the temperature change of the ejection unit 35 or the change of the viscosity of the ink, it is possible to accurately determine the ejection state in the ejection state determining process because the threshold value D corresponding to the change is reset if necessary.

B. Second Embodiment

In the determination criteria decision process according to the above-described first embodiment, the reference value Da which is the center of the range Ra used for determination on the ejection state of the central ejection unit and the reference value Db which is the center of the range Rb used for determination of the ejection state of the peripheral ejection unit are the same values with each other. That is, in the first embodiment, both of the reference values Da and Db are the most frequent values of the cycle Tc of the residual vibration generated in the M number ejection units 35 of the respective nozzle arrays.

In contrast, the second embodiment is different from the first embodiment in terms of deciding the reference value Da which is the center of the range Ra to be different from the reference value Db which is the center of the range Rb.

Further, the ink jet printer according to the second embodiment is configured in the same manner as the ink jet printer 1 according to the first embodiment except that the range Rb decided in the determination criteria decision process is different from that of the ink jet printer 1 according to the first embodiment.

In the second embodiment exemplified below, detailed description on elements having actions or functions which are the same as those in the first embodiment will be omitted by denoting the same reference numerals referred in the description above (the same applies to embodiments and modified examples described below).

Figure 25A:
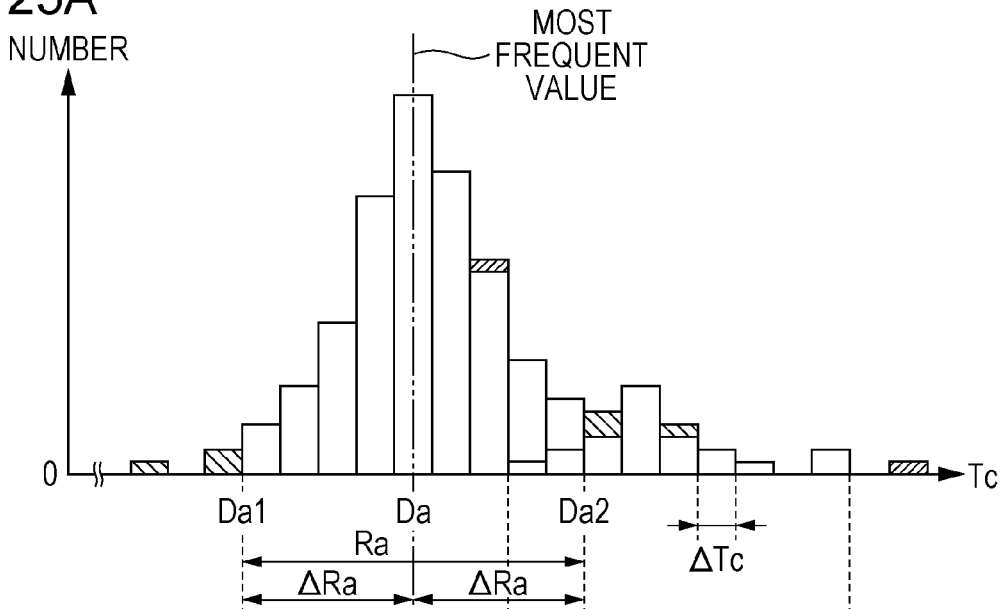
FIGS. 25A to 25C are histograms illustrating distribution of the cycle of the residual vibration generated in the ejection unit corresponding to respective nozzle arrays.
Figure 25B:
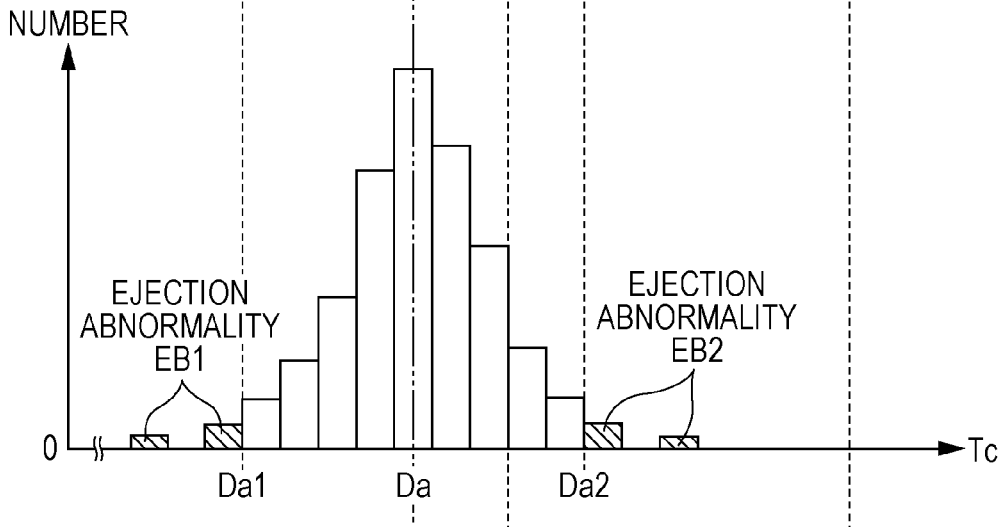
Figure 25C:
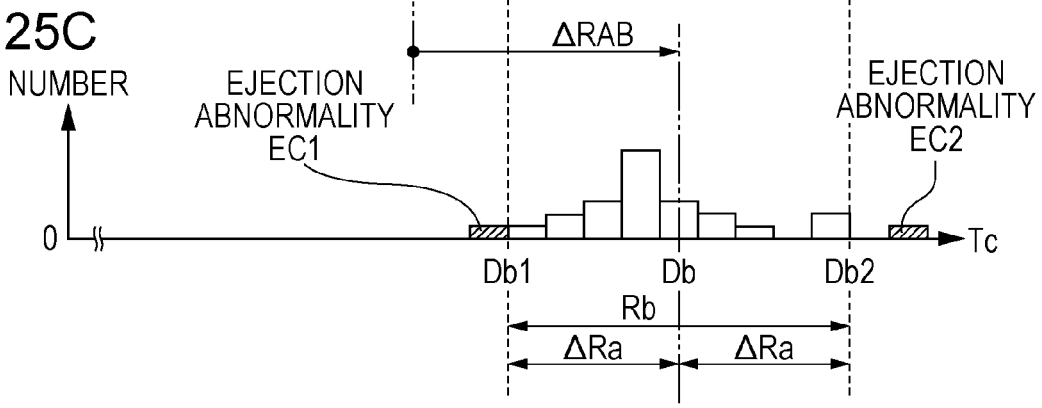

FIGS. 25A to 25C are histograms illustrating an example of distribution of values (cycle Tc of the residual vibration) of the detection signals NTc based on the M number of residual vibration signals Vout detected on the M number of ejection units 35 corresponding to one nozzle array among 4 nozzle arrays included in the head unit 30 similarly to FIGS. 23A to 23C. Among these, FIG. 25A illustrates distribution of the cycle Tc on the M number of ejection units 35 corresponding to one nozzle array, FIG. 25B illustrates distribution of the cycle Tc on $\alpha$ number of central ejection units among the M ejection units 35, and FIG. 25C illustrates distribution of the cycle Tc on $\beta$ number of peripheral ejection units among the M number of ejection units 35.

In the determination criteria decision process according to the second embodiment, similarly to the first embodiment, the range Ra used for determination on the ejection state of the central ejection unit is decided as a range which is divided into the threshold value Da1 in which the difference constant ΔRa is subtracted from the reference value Da and the threshold value Da2 in which the difference constant ΔRa is added to the reference value Da which are the most frequent values in the histogram illustrated in FIG. 25A.

In the determination criteria decision process according to the second embodiment, as illustrated in FIG. 25C, the range Rb used for determination on the ejection state of the peripheral edge ejection unit is decided as a range which is divided into the threshold value Db1 in which the difference constant ΔRa is subtracted from the reference value Db obtained by adding the difference value ΔRAB to the reference value Da and the threshold value Db2 in which the difference constant ΔRa is added to the reference value Db.

In this manner, in the determination criteria decision process according to the second embodiment, the reference value Db which is the center of the range Rb becomes larger than the reference value Da which is the center of the range Ra. That is, the threshold value Db1 becomes larger than the threshold value Da1 and the threshold value Db2 becomes larger than the threshold value Da2.

Accordingly, it is possible to perform the ejection state determining process in consideration of the cycle Tc of the residual vibration of the peripheral edge ejection unit being larger than that of the central ejection unit and to accurately determine the ejection state on both of the central ejection unit and the peripheral edge ejection unit.

Further, the determination criteria decision process according to the second embodiment, the ranges Ra and Rb are decided such that the width of the range Ra (difference between the threshold value Da2 and the threshold value Da1) becomes equivalent to the width of the range Rb (difference between the threshold value Db2 and the threshold value Db1). Specifically, both of the ranges Ra and Rb are decided such that the width of the range Ra and the width of the range Rb become "2ΔRa."

Therefore, in the peripheral ejection unit having the cycle Tc of the residual vibration being larger than that of the central ejection unit, in a case where ejection abnormality occurs due to mixture of the bubbles or the like and the cycle Tc becomes shorter than that of the peripheral ejection unit whose ejection state is normal, that is, in a case where ejection abnormality occurs as illustrated in the portion EC1 of FIG. 23C or 25C.

Figure 26:
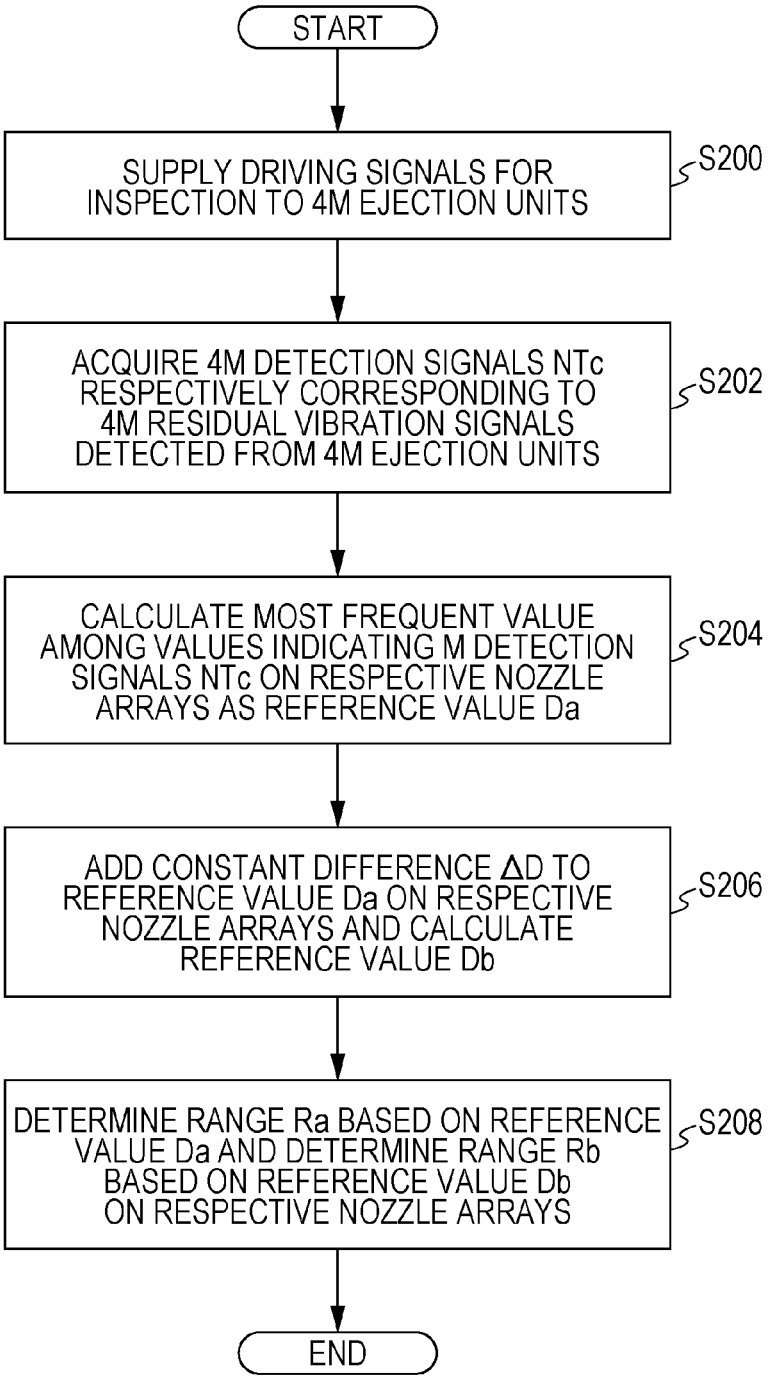
FIG. 26 is a flowchart illustrating an operation of an ink jet printer in a determination criteria decision process according to a second embodiment.

FIG. 26 is a flowchart illustrating an example of the operation of the ink jet printer 1 in the determination criteria decision process according to the second embodiment. The determination criteria decision process illustrated in the flowchart is performed at the time of initial setting of the ink jet printer 1, starting up the power, or warming up before the printing process is performed similarly to the first embodiment.

In the determination criteria decision process according to the second embodiment, firstly, the CUP 61 of the control unit 6 supplies the driving signal Vin for inspection to 4M number of ejection units 35 (Step S200).

In addition, the CPU 61 acquires the 4M number of detection signals NTc generated by the ejection abnormality detection unit 52 based on the 4M number of residual vibration signals Vout respectively output from the 4M ejection units 35 to which the driving signal Vin for inspection is supplied (Step S202).

Subsequently, the CUP 61 decides the most frequent value indicated by the M number of detection signals NTc corresponding to the M number of ejection units 35 in the respective nozzle arrays in each of the 4 nozzle arrays as the reference value Da (Step S204).

Next, the CPU 61 decides the value in which the difference constant ΔRAB is added to the reference value Da as the reference value Db in each of 4 nozzle arrays (Step S206).

Further, the CPU 61 decides the range Ra by setting the value in which the difference value ΔRa is subtracted from the reference value Da as the threshold value Da1 and setting the value in which the difference constant ΔRa is added to the reference value Da as the threshold value Da2, and decides the range Rb by setting the value in which the difference value ΔRa is subtracted from the reference value Db as the threshold value Db1 and setting the value in which the difference constant ΔRa is added to the reference value Db as the threshold value Db2 in each of 4 nozzle arrays (Step S208).

Further, although not illustrated in FIGS. 25A to 25C and 26, the threshold value D3 (threshold values Da3 and Db3) may be decided in the determination criteria decision process. For example, the threshold value Da3 may be decided by adding the predetermined value to the reference value Da. Similarly, the threshold value Db3 may be decided by adding the predetermined value to the reference value Db.

In this manner, in the determination criteria decision process according to the second embodiment, the reference value Db becomes larger than the reference value Da, and the ranges Ra and Rb are decided such that the width of the range Ra becomes equivalent to the width of the range Rb.

Therefore, it is possible to perform the ejection state determining process in consideration of the cycle Tc of the residual vibration of the peripheral edge ejection unit being larger than that of the central ejection unit and to accurately determine the ejection state on both of the central ejection unit and the peripheral edge ejection unit.

C. Third Embodiment

In the above-described first embodiment and the second embodiment, both of the ranges Ra and Rb are decided based on the distribution (and the most frequent value) of the cycle Tc of the residual vibration generated in M number of ejection units 35 of the respective nozzle arrays.

More specifically, in the first embodiment, the most frequent value of the cycle Tc of the residual vibration generated in the M number of ejection units 35 of the respective nozzle arrays is set as the reference values Da and Db and the ranges Ra and Rb are decided based on these values. Further, in the second embodiment, the ranges Ra and Rb are decided by setting the most frequent value of the cycle Tc of the residual vibration generated in the M number of ejection units 35 of the respective nozzle arrays as the reference value Da and setting the value in which the difference constant ΔRAB is added to the most frequent value as the reference value Db.

In contrast, in the third embodiment, the range Ra is decided based on the distribution (and the most frequent value) of the cycle Tc of the residual vibration generated in the α number of central ejection units among the M number of ejection units 35 of the respective nozzle arrays, and the range Rb is decided based on the distribution (and the most frequent value) of the cycle Tc of the residual vibration generated in the β number of peripheral edge ejection units among the M number of ejection units 35 of the respective nozzle arrays.

Further, the ink jet printer according to the third embodiment is configured in the same manner as the ink jet printer 1 according to the first embodiment except that the ranges Ra and Rb decided in the determination criteria decision process are different from those of the ink jet printer 1 according to the first embodiment.

Figure 27A:
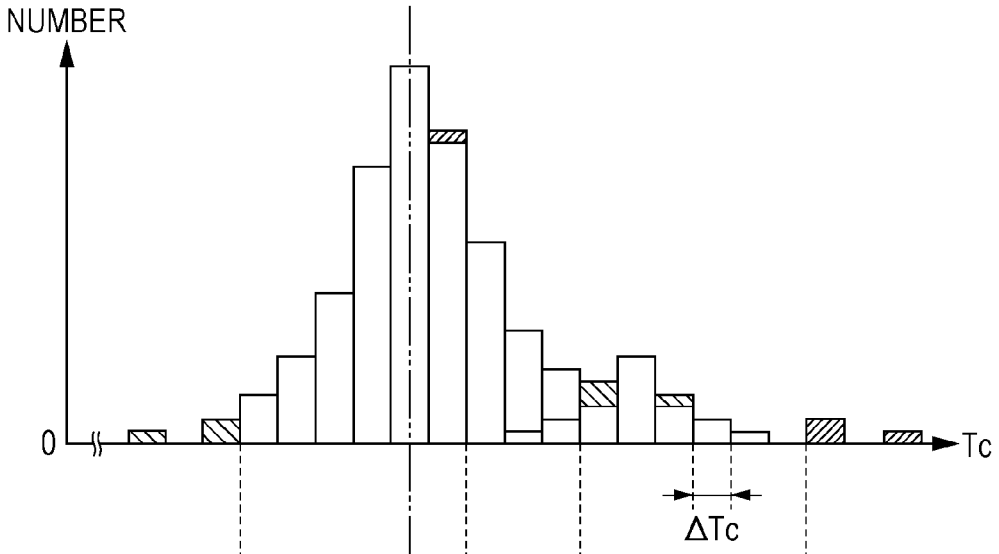
FIGS. 27A to 27C are histograms illustrating distribution of the cycle of the residual vibration generated in the ejection unit corresponding to respective nozzle arrays.
Figure 27B:
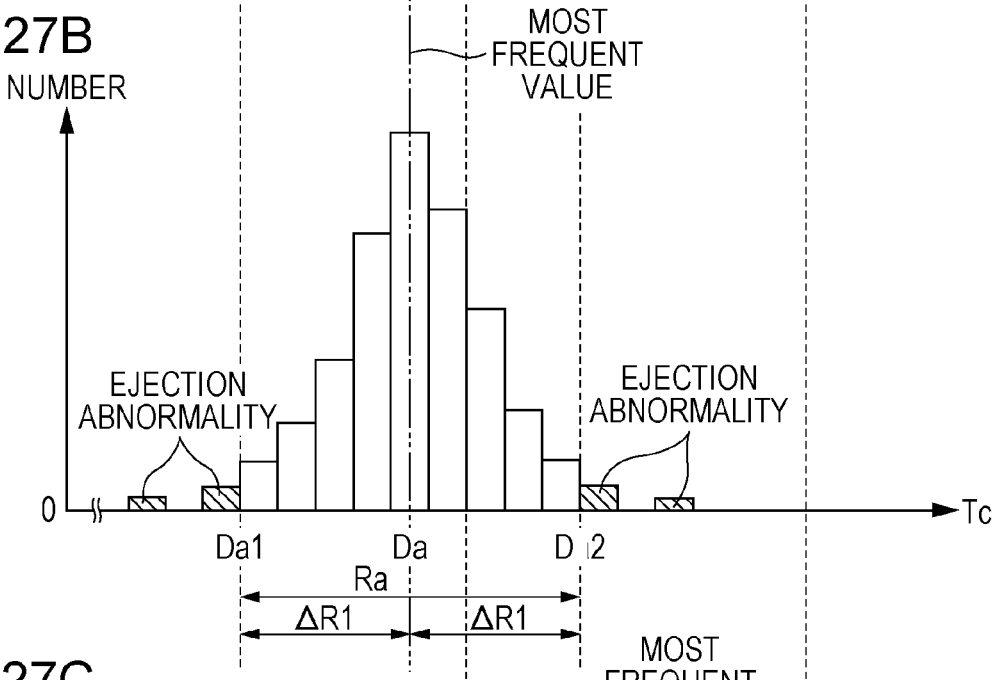
Figure 27C:
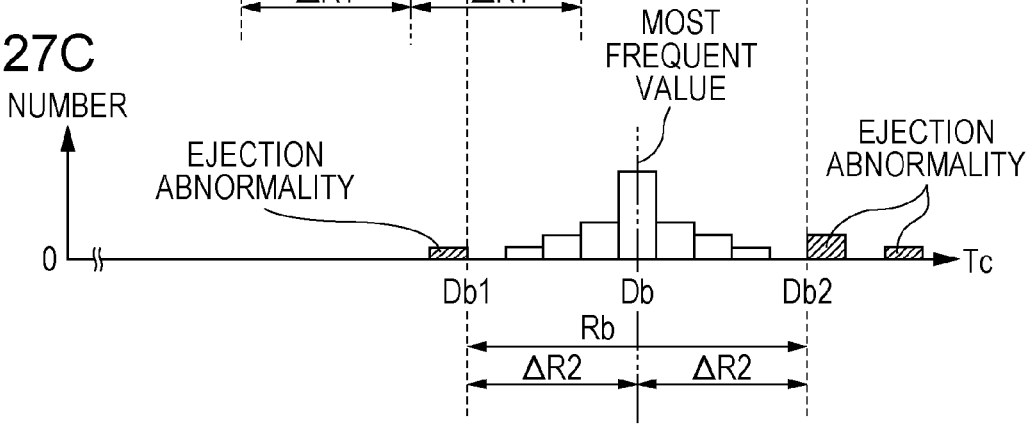

FIGS. 27A to 27C are histograms illustrating an example of the distribution of values (cycle Tc of the residual vibration) of the detection signals NTc based on the M number of residual vibration signals Vout detected on the M number of ejection units 35 corresponding to one nozzle array among 4 nozzle arrays included in the head unit similarly to FIGS. 23A to 25C. Among these, FIG. 27A illustrates distribution of the cycle Tc on the M number of ejection units 35 corresponding to one nozzle array, FIG. 27B illustrates distribution of the cycle Tc on the α number of central ejection units among the M ejection units 35, and FIG. 27C illustrates distribution of the cycle Tc on the β number of peripheral ejection units among the M number of ejection units 35.

In the determination criteria decision process according to the third embodiment, the range Ra used for determination on the ejection state of the central ejection unit is decided as a range which is divided into the threshold value Da1 in which the difference constant ΔR1 is subtracted from the reference value Da and the threshold value Da2 in which the difference constant ΔR1 is added to the reference value Da which are the most frequent values in the histogram illustrated in FIG. 27B.

In the determination criteria decision process according to the third embodiment, the range Rb used for determination on the ejection state of the peripheral edge ejection unit is decided as a range which is divided into the threshold value Db1 in which the difference constant ΔR2 is subtracted from the reference value Db and the threshold value Db2 in which the difference constant ΔR2 is added to the reference value Db which are the most frequent values in the histogram illustrated in FIG. 27C.

Further, the difference constants ΔR1 and ΔR2 may be predetermined constants. In addition, the difference constants ΔR1 and ΔR2 may be decided such that a ratio of the number of the central ejection units corresponding to the cycle Tc belonging to the range Ra to the α number of central ejection units becomes a predetermined ratio and a ratio of the number of the peripheral edge ejection units corresponding to the cycle Tc belonging to the range Rb to the β number of central ejection units becomes a predetermined ratio.

Figure 28:
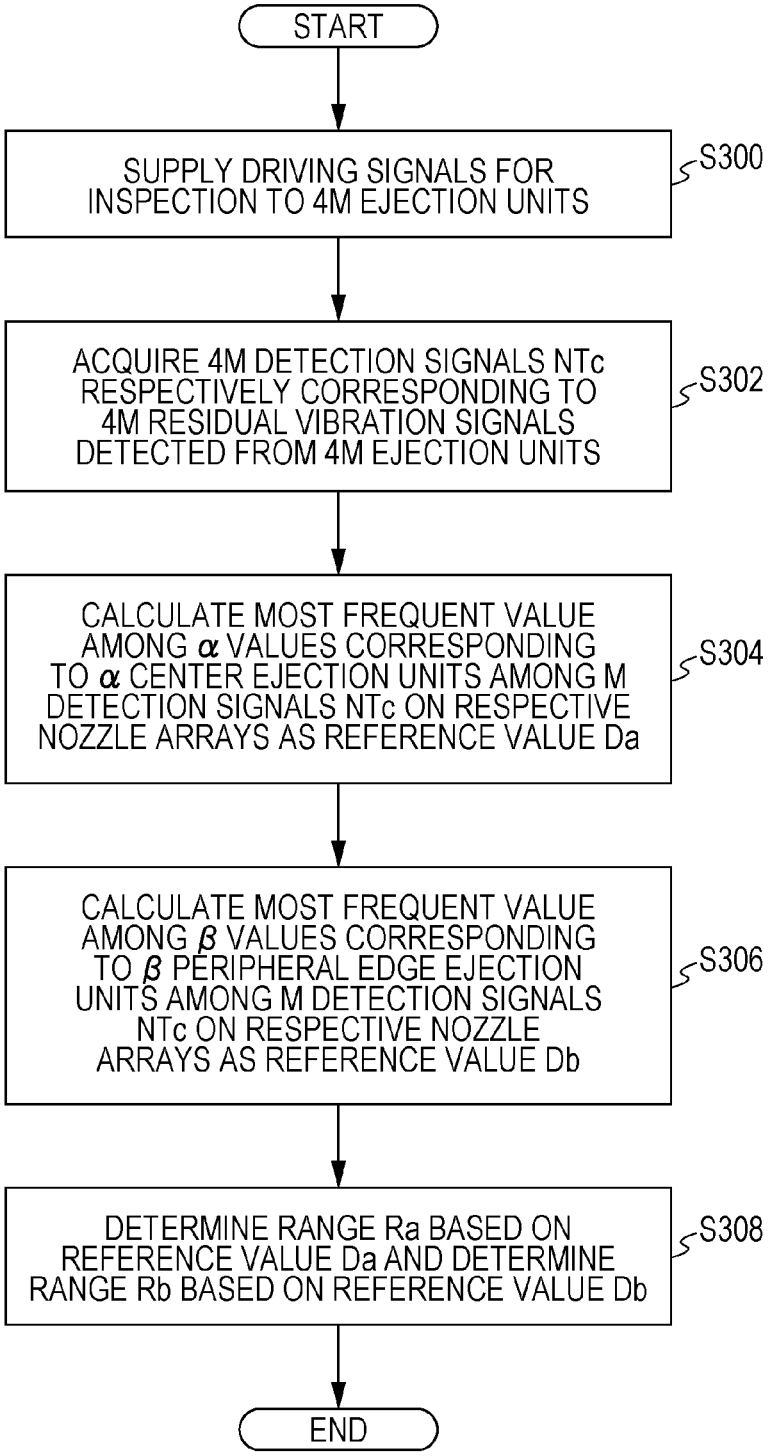
FIG. 28 is a flowchart illustrating an operation of an ink jet printer in a determination criteria decision process according to a third embodiment.

FIG. 28 is a flowchart illustrating an example of the operation of the ink jet printer 1 in the determination criteria decision process. Similarly to the first embodiments, the determination criteria decision process illustrated in the flowchart is performed at the time of, for example, initial setting and starting up the power, or warming-up before the ink jet printer 1 operates the printing process.

In the determination criteria decision process according to the third embodiment, firstly, the CUP 61 of the control unit 6 supplies the driving signal Vin for inspection to each of the 4M number of ejection units 35 (Step S300).

In addition, the CPU 61 acquires the 4M number of detection signals NTc generated by the ejection abnormality detection unit 52 based on the 4M number of residual vibration signals Vout respectively output from the 4M number of ejection units 35 to which the driving signal Vin for inspection is supplied (Step S302).

Subsequently, the CUP 61 decides the most frequent value indicated by the α number of detection signals NTc corresponding to the α number of central ejection units in the respective nozzle arrays in each of the 4 nozzle arrays as the reference value Da (Step S304).

Further, the CUP 61 decides the most frequent value indicated by the β number of detection signals NTc corresponding to the β number of peripheral edge ejection units in the respective nozzle arrays in each of the 4 nozzle arrays as the reference value Db (Step S306).

Further, the CPU 61 decides the range Rb by setting the value in which the difference constant ΔR1 is subtracted from the reference value Da as the threshold value Da1 and setting the value in which the difference constant ΔR1 is added to the reference value Da as the threshold value Da2, and decides the range Rb by setting the value in which the difference constant ΔR2 is subtracted from the reference value Db as the threshold value Db1 and setting the value in which the difference constant ΔR2 is added to the reference value Db as the threshold value Db2 in each of 4 nozzle arrays (Step S308).

Further, although not illustrated in FIGS. 27A to 27C and 28, the threshold value D3 (threshold values Da3 and Db3) may be decided in the determination criteria decision process. For example, the threshold value Da3 may be decided by adding the predetermined value to the reference value Da.

Similarly, the threshold value Db3 may be decided by adding the predetermined value to the reference value Db.

In this manner, in the determination criteria decision process according to the third embodiment, the reference value Da and the range Ra are decided based on the distribution of the cycle Tc according to the α number of central ejection units illustrated in FIG. 27B, and the reference value Db and the range Rb are decided based on the distribution of the cycle Tc according to the β number of peripheral edge ejection units illustrated in FIG. 27C.

Therefore, it is possible to perform the ejection state determining process in consideration of the cycle Tc of the residual vibration being different between the central ejection unit and the peripheral edge ejection unit and to accurately determine the ejection state on both of the central ejection unit and the peripheral edge ejection unit.

D. MODIFIED EXAMPLES

The above-described respective aspects may be variously modified. Aspects of specific modifications will be exemplified below. Two or more aspects which are randomly selected from the following exemplified modifications may be appropriately combined with each other within the scope without mutual conflict.

Modified Example 1

In the above-described first embodiment, in the determination reference setting process, as illustrated in FIGS. 23A to 23C and 24, the reference value Da and the reference value Db are the same as each other, and the range Ra and the range Rb are defined so that the range Ra is wider than the range Rb, but, the invention is not limited to this aspect. In the determination reference setting process related to the first embodiment, the reference value Da and the reference value Db may be different from each other, and the range Ra and the range Rb may be defined so that the range Rb is wider than the range Ra.

Modified Example 2

Figure 29:
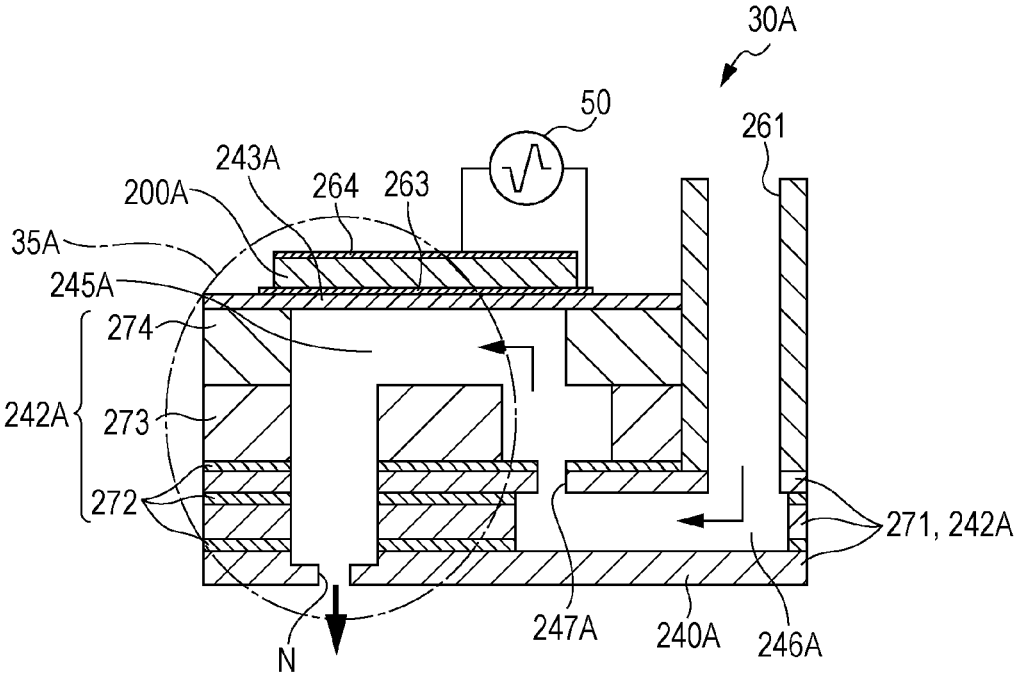
FIG. 29 is a cross-sectional view schematically illustrating a head unit according to Modified example 2.

In the above-described embodiments and modified example, the ink jet printer 1 includes the head unit 30 illustrated in FIG. 3, but the invention is not limited to this aspect, and a head unit 30A illustrated in FIG. 29 may be provided instead of the head unit 30 illustrated in FIG. 3.

The head unit 30A illustrated in FIG. 29 is different from the head unit 30 illustrated in FIG. 3 in that an ejection unit 35A is provided instead of the ejection portion 35, and a reservoir 246A is provided instead of the reservoir 246. In addition, the head unit 30A is different from the head unit 30 in that a nozzle plate 240A is provided instead of the nozzle plate 240, and a cavity plate 242A is provided instead of the cavity plate 242.

The ejection portion 35A illustrated in FIG. 29 is different from the ejection portion 35 illustrated in FIG. 3 in that a single piezoelectric element 200A is provided instead of a plurality of piezoelectric elements 200, and a cavity 245A is provided instead of the cavity 245. In the ejection portion 35A, a vibration plate 243A vibrates due to driving of the piezoelectric element 200A, so as to eject ink in the cavity 245A from nozzles N.

The cavity plate 242A includes a first plate 271, an adhesive film 272, a second plate 273, and a third plate 274.

The first plate 271 is joined to the nozzle plate 240A made of stainless steel, provided with the nozzles N, via the adhesive film 272, and the same first plate 271 made of stainless steel is joined thereonto via the adhesive film 272. In addition, the second plate 273 and the third plate 274 are sequentially joined thereonto.

The nozzle plate 240A, the first plate 271, the adhesive film 272, the second plate 273, and the third plate 274 are formed in predetermined shapes (recessed shapes), and are made to overlap each other, so that the cavity 245A and the reservoir 246A are formed. The cavity 245A and the reservoir 246A communicate with each other via an ink supply port 247A. In addition, the reservoir 246A communicates with an ink intake port 261.

The vibration plate 243A is provided in an upper opening of the third plate 274, and the piezoelectric element 200A is joined to the vibration plate 243A via a lower electrode 263. In addition, an upper electrode 264 is joined to the piezoelectric element 200A on an opposite side to the lower electrode 263. The driving signal generation unit 51 supplies a driving signal Vin between the upper electrode 264 and the lower electrode 263, so as to cause the piezoelectric element 200A to vibrate, and thus to cause the vibration plate 243A joined thereto to vibrate. A volume of the cavity 245A (pressure in the cavity) varies due to the vibration of the vibration plate 243A, and thus ink which fills the cavity 245A is ejected from the nozzles N.

In a case where the ink is ejected, and thus an ink amount in the cavity 245A is reduced, ink is supplied from the reservoir 246A. In addition, ink is supplied to the reservoir 246A from the ink cartridge 31 via the ink intake port 261.

Modified Example 3

In the above-described embodiments and modified examples, as illustrated in FIG. 4, M nozzles N belonging to each nozzle string are arranged in a linear shape (in a line) in the extending direction of the X axis in the head unit 30, but the invention is not limited to this aspect. For example, as illustrated in FIG. 30, stages are shifted so that, among the M nozzles N belonging to each nozzle string, positions of odd-numbered nozzles N are even-numbered nozzles N in the Y axis direction are different from each other.

Modified Example 4

In the above-described embodiments and modified examples, the serial printer in which a main scanning direction of the head unit 30 is different from a sub-scanning direction of the recording paper P to be transported has been described as an example of an ink jet printer, but the invention is not limited thereto, and a line printer may be used in which a width of the head unit 30 is equal to or greater than a width of the recording paper P.

Figure 30:
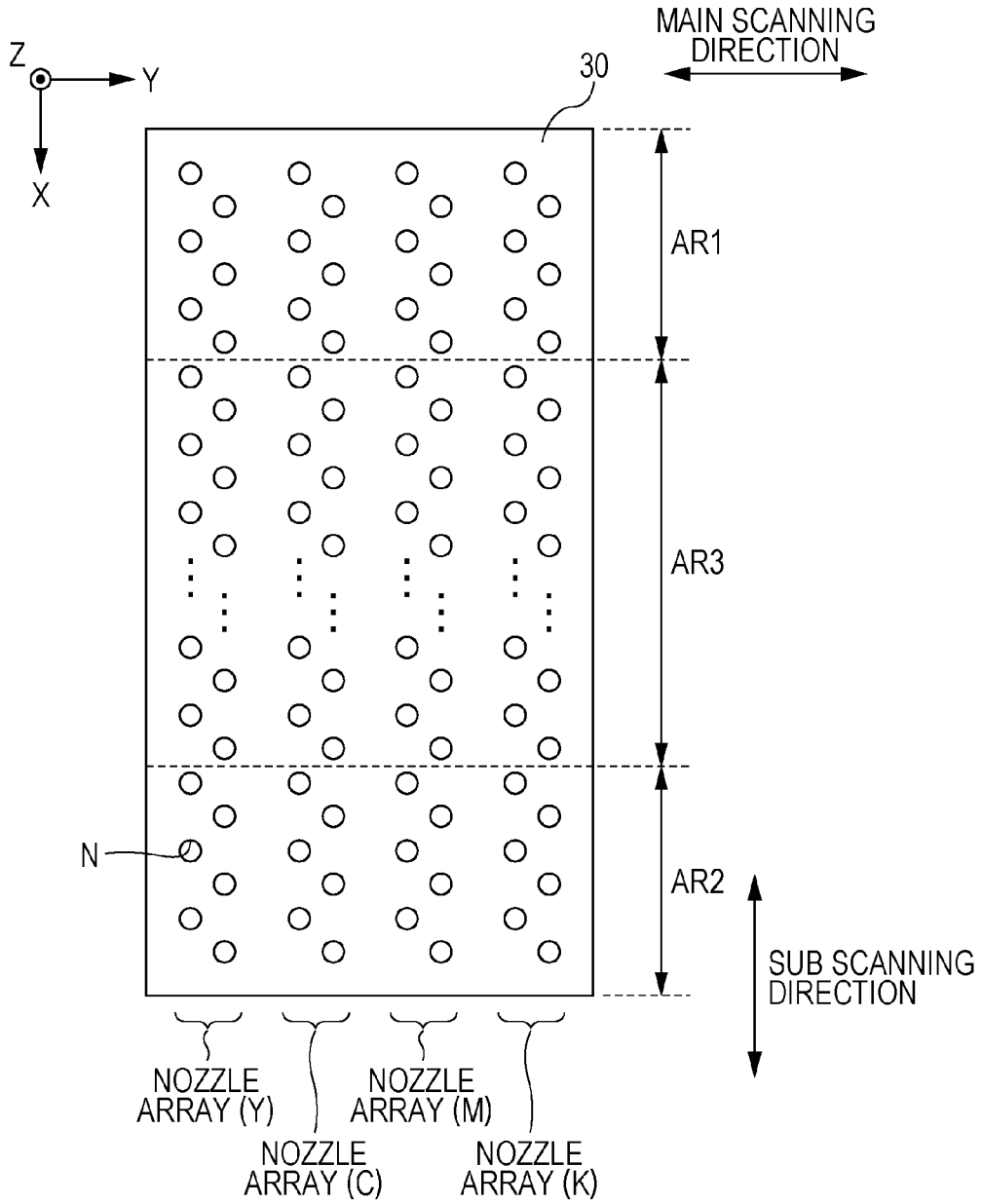
FIG. 30 is a plan view illustrating an arrangement example of nozzles in a head unit according to Modified example 3.

In a case where an ink jet printer is the line printer, in each nozzle string provided in the head unit 30, illustrated in FIG. 4 or 30, M nozzles N belonging to each nozzle string are arranged in a line in the extending direction of the Y axis or in a shifted stage. In addition, also in this case, the region AR1, the region AR2, and the region AR3 are provided so that the number of M nozzles N belonging to each nozzle array is β1, β2, and α in the regions, respectively.

Modified Example 5

In the above-described embodiments and modified examples, the ejection abnormality detection unit 52 includes 4M ejection abnormality detection circuits DT which are in a one-to-one relationship with 4M ejection units 35, but the ejection abnormality detection unit 52 may include at least one ejection abnormality detection circuit DT.

In this case, the control unit 6 may select a single ejection unit 35 from among the 4M ejection units 35 as a target of the ejection state determining process in the unit operation period Tu in which the ejection state determining process, and may supply a switching control signal Sw for electrically connecting the selected ejection unit 35 to the ejection abnormality detection circuit DT, to the switching unit 53.

Modified Example 6

In the above-described embodiments and modified examples, a determination of an ink ejection state in the ejection unit 35 is performed by the determination unit 56, but the invention is not limited to this aspect, and the ejection state determination may be performed by the control unit 6 (CPU 61).

In a case where the CPU 61 performs the ejection state determination, the ejection abnormality detection circuit DT of the ejection abnormality detection unit 52 may not be provided with the determination unit 56, and a detection signal NTc generated by the detection unit 55 may be output to the control unit 6.

Figure 31:
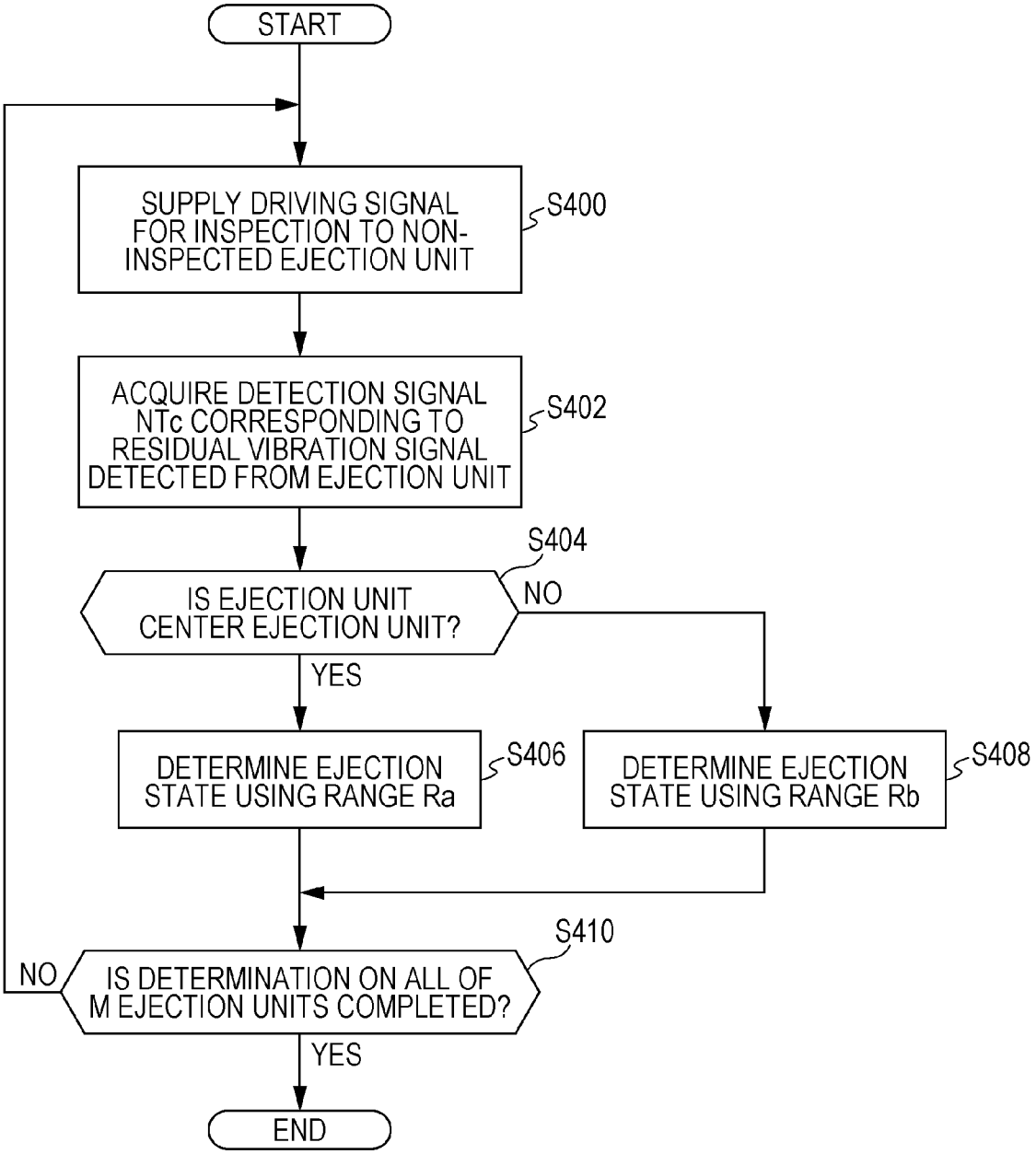
FIG. 31 is a flowchart illustrating an operation of an ink jet printer in an ejection state determining process according to Modified example 6.

FIG. 31 is a flowchart illustrating an ejection state determining process in a case where the CPU 61 performs a determination of an ejection state in the ejection unit 35. Hereinafter, description will be made of an operation of the CPU 61 in the ejection state determining process of the present modified example. In addition, in this flowchart, it is assumed that the ejection abnormality detection unit 52 includes only one ejection abnormality detection circuit DT as in the ink jet printer related to Modified example 5.

When the ejection state determination process starts, first, the CPU 61 selects a single ejection unit 35 which is a target of the ejection state determination process in the unit operation period Tu, and controls driving of the head driver 50 so that a driving signal Vin is supplied to the selected ejection unit 35 (step S400). In addition, in step S400, the CPU 61 selects a single ejection unit 35 from among the ejection units 35 other than the ejection units 35 on which the ejection state determination process has already has been performed.

Next, the CPU 61 acquires a detection signal NTc which is generated by the ejection abnormality detection unit 52 on the basis of a residual vibration signal Vout which is output from the ejection unit 35 selected in the corresponding unit operation period Tu (step S402).

Next, the CPU 61 determines whether or not the ejection unit 35 selected in the corresponding unit operation period Tu is a central ejection unit (step S404).

If a determination result in step S404 is affirmative, the CPU 61 determines whether or not a value indicated by the detection signal NTc is included in the range Ra (and the value indicated by the detection signal NTc is equal to or greater than a threshold value Da3), and thus determines an ejection state of the ejection unit 35 (step S406).

On the other hand, if the determination result in step S404 is negative, the CPU 61 determines whether or not a value indicated by the detection signal NTc is included in the range Rb (and the value indicated by the detection signal NTc is equal to or greater than a threshold value Db3), and thus determines an ejection state of the ejection unit 35 (step S408).

In addition, the CPU 61 determines whether or not a determination of an ejection state is completed for all of the 4M ejection units 35 in the ejection state determination process (step S410). If a determination result in step S410 is affirmative, in other words, the determination of an ejection state has been performed on all the 4M ejection units 35, the CPU 61 finishes the ejection state determination process. On the other hand, if the determination result in step S410 is negative, in other words, the determination of an ejection state is not completed for some of the 4M ejection units 35, the CPU 61 makes the process proceed to step S400.

As mentioned above, in the ejection state determination process, an ejection state of the central ejection unit is determined by using the range Ra as a reference in relation to, and an ejection state of the peripheral ejection units is determined by using the range Rb as a reference. Therefore, it is possible to perform an accurate determination of an ejection state in consideration of a difference in operation characteristics.

Modified Example 7

In the above-described embodiments and modified examples, the head unit 30 is divided into the region AR1, the region AR2, and the region AR3, and the M nozzles N belonging to each nozzle string and the M ejection units 35 corresponding thereto are classified into two types including a central ejection unit (central nozzle) and a peripheral edge ejection unit (peripheral nozzle) according to a region in which the nozzle and the ejection unit 35 are disposed, but the invention is not limited to this aspect. The head unit 30 may be divided into three or more regions, and the M nozzles N belonging to each nozzle string and the M ejection units 35 corresponding thereto may be classified into three or more types according to a region in which the nozzle and the ejection unit 35 are disposed.

In this case, in a determination reference setting process, threshold values D (a threshold value D1, a threshold value D2, and a threshold value D3) may be set to be larger in the ejection unit 35 disposed in a region close to the upper L1 or the lower end L2 (refer to FIG. 4) of the head unit 30 than in the ejection unit 35 in a region far from the upper end L1 or the lower L2.

Modified Example 8

In the above-described embodiments and modified examples, a driving signal waveform signal Com includes three signals including Com-A, Com-B, and Com-C, but the invention is not limited to this aspect. The driving signal waveform signal Com may include a single signal (for example, only Com-A), and may include any number of signals of two or more (for example, Com-A and Com-B).

In addition, in the above-described embodiments and modified examples, the control unit 6 simultaneously supplies, as the driving waveform signal Com, driving waveform signals Com-A and Com-B (hereinafter, referred to as printing driving waveform signals) for generating a driving signal Vin for printing along with a driving waveform signal Com-C (hereinafter, referred to as an inspection driving waveform signal) for generating a driving signal Vin for inspection in each unit operation period Tu, and the invention is not limited to this aspect. For example, in a case where a printing process is performed in a certain unit operation period Tu, the control unit 6 supplies the driving waveform signal Com (for example, the driving waveform signal Com including only Com-A and Com-B) including the printing driving waveform signals, and, in a case where an ejection state determination process or a determination reference setting process is performed in a certain unit operation period Tu, the control unit supplies the driving waveform signal Com (for example, Com-C instead of Com-A) including only an inspection driving waveform signal. As mentioned above, a waveform of each signal included in the driving waveform signal Com may be changed depending on a type of process performed in each unit operation period Tu.

In addition, the number of bits of the printing signal SI is not limited to 3 bits, and may be determined as appropriate depending on a grayscale to be displayed or the number of signals included in the driving waveform signal Com.

Modified Example 9

In the above-described embodiments and modified examples, the head driver 50 generates driving signals Vin which are supplied to the 4M ejection units 35, on the basis of the same driving waveform signal Com, but the invention is not limited to this aspect. The head driver may generate driving signals Vin for each of the M ejection units 35 corresponding to each nozzle string on the basis of the four driving waveform signals Com which have an one-to-one relationship with 4 nozzle strings.

For example, the control unit 6 may output four driving waveform signals Com including a driving waveform signal Com corresponding to yellow, a driving waveform signal Com corresponding to cyan, a driving waveform signal Com corresponding to magenta, and a driving waveform signal Com corresponding to black, to the head driver 50. In addition, in this case, the head driver 50 may supply a driving signal Vin which is generated on the basis of the driving waveform signal Com corresponding to yellow, to the M ejection units 35 corresponding to a yellow nozzle string, may supply a driving signal Vin which is generated on the basis of the driving waveform signal Com corresponding to cyan, to the M ejection units 35 corresponding to a cyan nozzle string, may supply a driving signal Vin which is generated on the basis of the driving waveform signal Com corresponding to magenta, to the M ejection units 35 corresponding to a magenta nozzle string, and may supply a driving signal Vin which is generated on the basis of the driving waveform signal Com corresponding to black, to the M ejection units 35 corresponding to a black nozzle string. In addition, in this case, the head driver 50 may include, for example, four driving signal generation units 51 including a driving signal generation unit 51 corresponding to yellow, a driving signal generation unit 51 corresponding to cyan, a driving signal generation unit 51 corresponding to magenta, and a driving signal generation unit 51 corresponding to black.

Modified Example 10

In the determination reference setting process related to the above-described embodiments and modified examples, each ejection unit 35 is driven once, and thus M detection signals NTc are generated on the basis of M residual vibration signals Vout acquired from the M ejection units 35 corresponding to each nozzle string, so that the range Ra and the range Rb are set on the basis of a distribution of values indicated by the M detection signals NTc, but the invention is not limited to this aspect.

For example, in the determination reference setting process, each ejection unit 35 may be driven for multiple times, and thus residual vibration signals Vout more than M may be acquired from the M ejection units 35 corresponding to each nozzle string so as to generate detection signals NTc more than M, thereby setting the range Ra and the range Rb on the basis of a distribution of values indicated by the M detection signals NTc more than M.

In the determination reference setting process, if each ejection unit 35 is driven for multiple times and a cycle Tc is obtained, it is possible to reduce influence of noise when the residual vibration signal Vout is detected, or when the cycle Tc is calculated (the detection signal NTc is generated).

Modified Example 11

The ink jet printer related to the above-described embodiments and modified examples includes four ink cartridges 31 corresponding to four colors including yellow, cyan, magenta, and black, and ejects ink of four colors, but the invention is not limited to this aspect. The ink jet printer may further include an ink cartridge 31 which is filled with ink of a color different from the four colors, and may include only the ink cartridges 31 corresponding to some of the four colors. In other words, the ink jet printer according to the invention may eject ink of one or more colors.

In addition, in the above-described embodiments and modified examples, the head unit 30 is provided with 4 nozzle strings so as to have a one-to-one relationship with ink of four colors, but the invention is not limited to this aspect, the head unit may be provided with nozzle strings of the same number as the number of colors of ink which can be ejected by the ink jet printer, and may be provided with two or more nozzle strings for each color.

The entire disclosure of Japanese Patent Application No. 2013-191435, filed Sep. 17, 2013 is expressly incorporated by reference herein.

What is claimed is:

1. A printing apparatus, comprising:

a driving signal generation unit that generates a driving signal;

a first ejection unit that includes a first piezoelectric element which is displaced according to the driving signal, a first pressure chamber whose inside is filled with a liquid and in which a pressure in the inside is increased or decreased due to the displacement of the first piezoelectric element based on the driving signal, and a first nozzle which communicates with the first pressure chamber and is capable of ejecting the liquid filled in the inside of the first pressure chamber due to the increase or the decrease of the pressure in the inside of the first pressure chamber;

a second ejection unit that includes a second piezoelectric element which is displaced according to the driving signal, a second pressure chamber whose inside is filled with a liquid and in which a pressure in the inside is increased or decreased due to the displacement of the second piezoelectric element based on the driving signal, and a second nozzle which communicates with the second pressure chamber and is capable of ejecting the liquid filled in the inside of the second pressure chamber due to the increase or the decrease of the pressure in the inside of the second pressure chamber;

a detection unit that detects change of an electromotive force of the first piezoelectric element as a first residual vibration signal based on change of the pressure in the inside of the first pressure chamber, which is generated after the driving signal is supplied to the first piezoelectric element and detects change of an electromotive force of the second piezoelectric element as the second residual vibration signal based on change of the pressure in the inside of the second pressure chamber, which is generated after the driving signal is supplied to the second piezoelectric element; and a determination unit that determines an ejection state of the liquid in the first ejection unit and the second ejection unit based on the detection result of the detection unit; and a head unit that is provided with a plurality of the first ejection units and a plurality of the second ejection units, wherein the determination unit determines that the ejection state of the liquid in the first ejection unit is normal in a case where a cycle of a waveform indicated by the first residual vibration signal belongs to a first range and determines that the ejection state of the liquid in the second ejection unit is normal in a case where a cycle of a waveform indicated by the second residual vibration signal belongs to a second range, a part or all of the second range is a range which is not included in the first range, the head unit is divided into a first area, a second area, and a third area located between the first area and the second area, the plurality of first ejection units are provided in the first area and the second area of the head unit, and the plurality of second ejection units are provided in the third area of the head unit.

2. The printing apparatus according to claim 1, wherein a difference value between an upper limit and a lower limit of the first range is larger than a difference value between an upper limit and a lower limit of the second range.

3. The printing apparatus according to claim 1, wherein the upper limit of the first range is different from the upper limit of the second range, and the difference value between the upper limit and the lower limit of the first range is equivalent to the difference value between the upper limit and the lower limit of the second range.

4. The printing apparatus according to claim 1, wherein a Helmholtz resonance frequency of one of the plurality of first ejection units is lower than a Helmholtz resonance frequency of one of the plurality of second ejection units.

5. A method of controlling a printing apparatus which includes a driving signal generation unit that generates a driving signal;

a first ejection unit that includes a first piezoelectric element which is displaced according to the driving signal, a first pressure chamber whose inside is filled with a liquid and in which a pressure in the inside is increased or decreased due to the displacement of the first piezoelectric element based on the driving signal, and a first nozzle which communicates with the first pressure chamber and is capable of ejecting the liquid filled in the inside of the first pressure chamber due to the increase or the decrease of the pressure in the inside of the first pressure chamber;

a second ejection unit that includes a second piezoelectric element which is displaced according to the driving signal, a second pressure chamber whose inside is filled with a liquid and in which a pressure in the inside is increased or decreased due to the displacement of the second piezoelectric element based on the driving signal, and a second nozzle which communicates with the second pressure chamber and is capable of ejecting the liquid filled in the inside of the second pressure chamber due to the increase or the decrease of the pressure in the inside of the second pressure chamber;

a detection unit that detects change of an electromotive force of the first piezoelectric element as a first residual vibration signal based on change of the pressure in the inside of the first pressure chamber, which is generated after the driving signal is supplied to the first piezoelectric element and detects change of an electromotive force of the second piezoelectric element as the second residual vibration signal based on change of the pressure in the inside of the second pressure chamber, which is generated after the driving signal is supplied to the second piezoelectric element; and a head unit that is provided with a plurality of the first ejection units and a plurality of the second ejection units, the method of controlling a printing apparatus, comprising:

determining an ejection state of the liquid in the first ejection unit to be normal in a case where a cycle of a waveform indicated by the first residual vibration signal belongs to a first range; and determining the ejection state of the liquid in the second ejection unit to be normal in a case where a cycle of a waveform indicated by the second residual vibration signal belongs to a second range, wherein a part or all of the second range is a range which is not included in the first range, the head unit is divided into a first area, a second area, and a third area located between the first area and the second area, the plurality of first ejection units are provided in the first area and the second area of the head unit, and the plurality of second ejection units are provided in the third area of the head unit.

* * * * *